US006231177B1

(12) United States Patent
Cherukuri et al.

(10) Patent No.: US 6,231,177 B1
(45) **Date of Patent: *May 15, 2001**

(54) FINAL PRINT MEDIUM HAVING TARGET REGIONS CORRESPONDING TO THE NOZZLE OF PRINT ARRAY

(75) Inventors: Satyam C. Cherukuri, Mercer; Judith Ann Ladd, Hamilton; Sterling E. McBride, Lawrenceville, all of NJ (US); Pamela K. York, Yardley, PA (US)

(73) Assignee: Sarnoff Corporation, Princeton, NJ (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/159,564

(22) Filed: Sep. 24, 1998

Related U.S. Application Data

(60) Provisional application No. 60/060,321, filed on Sep. 29, 1997.

(51) Int. Cl.[7] ..... B41J 2/01

(52) U.S. Cl. ..... 347/105; 428/211; 428/195; 346/140.1

(58) Field of Search ..... 347/54, 53, 3, 347/105, 103, 106; 346/140.1; 428/211, 195

(56) References Cited

U.S. PATENT DOCUMENTS

| | | | | |
|---|---|---|---|---|
| 3,870,435 | * | 3/1975 | Watanabe | 347/96 X |
| 4,162,502 | * | 7/1979 | Cielo | 347/55 |
| 4,263,601 | | 4/1981 | Nishimura et al. | 346/1.1 |
| 4,387,382 | * | 6/1983 | Kohashi | 347/55 |
| 4,718,340 | * | 1/1988 | Love | 347/105 X |
| 4,809,021 | * | 2/1989 | Check | 347/15 X |
| 4,855,768 | * | 8/1989 | Iino | 347/55 |
| 4,890,126 | * | 12/1989 | Hotomi | 347/55 X |
| 5,185,615 | * | 2/1993 | Koitabashi | 347/12 X |
| 5,659,346 | * | 8/1997 | Moynihan | 347/71 X |
| 5,689,295 | * | 11/1997 | Eremin et al. | 347/43 |
| 5,764,258 | * | 6/1998 | Hetzer | 347/85 |
| 5,771,810 | * | 6/1998 | Wolcott | 347/3 X |
| 5,973,708 | * | 10/1999 | Fassler et al. | 346/140.1 |
| 6,015,620 | * | 1/2000 | Schwarz, Jr. | 428/411.1 |
| 6,046,755 | * | 4/2000 | Hawkins | 346/140.1 |

FOREIGN PATENT DOCUMENTS

| | | | | |
|---|---|---|---|---|
| 97/18950 | * | 5/1997 | (WO) | B41C/1/10 |

* cited by examiner

*Primary Examiner*—John Barlow
*Assistant Examiner*—Michael S Brooke
(74) *Attorney, Agent, or Firm*—William J. Burke

(57) ABSTRACT

A final print medium for receiving fluid to form an image has a plurality of target regions formed for receiving the fluid, wherein the target regions are separated by hydrophobic regions. The target regions and the hydrophobic regions are configured to receive the fluid from corresponding nozzles of a print array.

9 Claims, 17 Drawing Sheets

FINAL PRINT MEDIUM HAVING TARGET REGIONS CORRESPONDING TO THE NOZZLE OF PRINT ARRAY

This application claims the benefit of U.S. Provisional Application Serial No. 60/060321 filed Sep. 29, 1997, which is incorporated herein by reference.

The invention relates to a print array and, more particularly, the invention relates to a print array that incorporates pumping means such as electro-hydrodynamic (EHD) micropumps, microchannels and reservoir(s) that allow electronic fluid modulation (EFM) to selectively dispense fluid from a reservoir onto a receptor and a method of transferring fluids to a receptor.

BACKGROUND

Current technology offers a variety of techniques to print information, e.g., text and images, onto a receptor, such as paper, Mylar sheet or coated material. Many of the printing techniques are based on the physical transport of a pigment or ink from a reservoir to a receptor in a controlled manner. In FIG. 1 a printing system 100, which can be represented by three broad parts: 1) a storage 110 for the pigment, 2) a transport mechanism 120 to deliver the pigment and 3) a receptor 130 to receive the pigment, e.g., a print media, is shown.

The storage 110 can be implemented in a number of different manners, e.g., a toner cartridge for a laserjet printer that carries pigment in powder form, an inkjet cartridge for an inkjet printer that carries liquid pigment or a print ribbon in a dot matrix printer.

Similarly, the transport mechanism 120 can be implemented in a number of different ways e.g., the formation and propulsion of droplets by thermal evaporation, acoustic waves or electrical means. Typically, the droplets exit the storage medium and travel a gap to reach the receptor as shown for example by Choi et al., in Society for Imaging Science and Technology, pages 33–35, (1996) and by Crowley, U.S. Pat. No. 4,220,958.

These printing technologies are often-components of a much larger system or they must be manipulated or serviced by a larger system to perform their primary printing function. More importantly, the transport mechanism generally requires a significant amount of energy to perform properly, e.g., a high voltage is needed to evaporate droplets onto a paper. This limitation significantly reduces the portability of the printing device. Thus, a need exists in the art for a print array that is capable of forming precise droplets that can be dispensed onto a receptor in a high-density formation with relatively low power.

SUMMARY OF THE INVENTION

The invention is a method and apparatus for selectively transferring fluid(s) from the reservoir(s) to a receptor. The invention includes print array having a plurality of layers for delivering a fluid to a receptor, said print array comprising a reservoir for carrying the fluid, a microchannel, coupled to said reservoir, said microchannel having a hydrophilic region and a hydrophobic region, and a micropump, coupled to said microchannel, where said micropump, responsive to a control signal, causes said fluid to flow to a location onto the receptor. The print array may comprise a plurality of layers for delivering fluid to a receptor, the array comprising a distribution channel for carrying a fluid, wherein said distribution channel is located on a first layer having a plurality of air relief, and a dispenser, coupled to said distribution channel, wherein said dispenser has a micropump that is responsive to a control signal that causes said fluid to flow to a location on the receptor, wherein said dispenser is located on a second layer.

The invention also includes a print medium for receiving a fluid from the print array, the print medium comprising a target region for receiving said fluid, and a hydrophobic region.

The invention also includes a printing system comprising a general-purpose controller, a print array interface and a print array.

The invention also includes a method of operating a print array, comprising the steps of determining an amount of fluid to be dispensed onto a receptor from the print array and applying a modulating control signal to dispense said determined amount of fluid.

BRIEF DESCRIPTION OF THE DRAWING

The teachings of the invention can be readily understood by considering the following detailed description in conjunction with the accompanying figures, in which.

To facilitate understanding, identical reference numerals have been used, where possible, to designate identical elements that are common to the figures.

DETAILED DESCRIPTION

Figure 1:
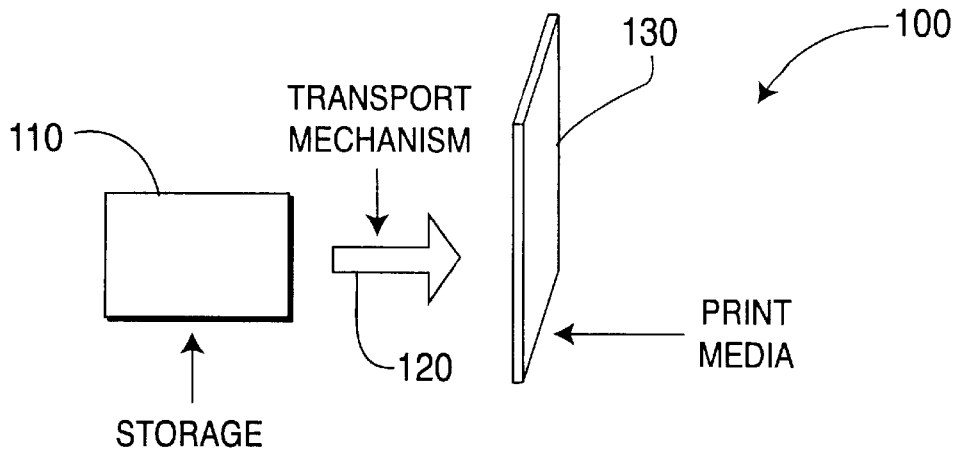
FIG. 1 PRIOR ART
FIG. 1 depicts a prior art printing system.
Figure 2:
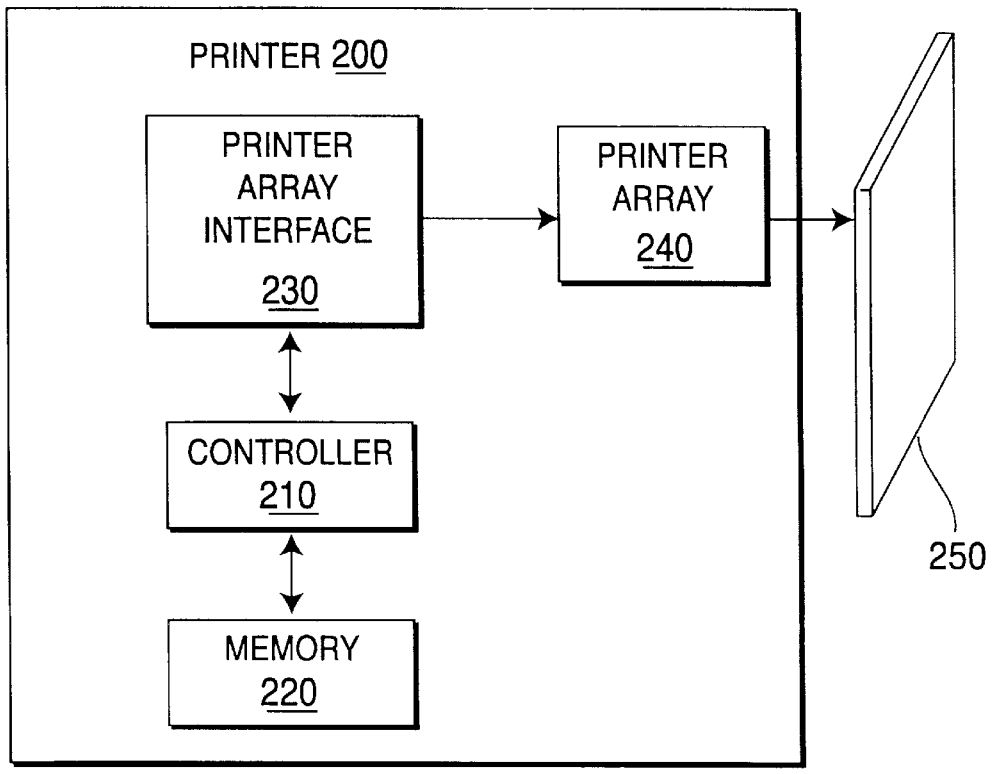
FIG. 2 is a block diagram of a print array residing within a printer system.

FIG. 2 depicts a block diagram of a print array residing within a printing system 200, e.g., a printer. The printer 200 may comprise a general purpose controller (processor, microcontroller, or application specific integrated circuit (ASIC)) 210, a memory 220, a print array interface 230 and a print array 240. It should be understood that although the invention is described below with regard to printing, the invention can be adapted to fluidic array in general.

The controller 210 controls the printing operation of the printer and can be designed to receive print commands from a number of different devices, e.g., a computer, an imaging device or a digital camera. In fact, the controller 210 is electrically coupled to the memory 220 which may be loaded with one or more software applications for controlling the printer and for communicating with the array 240 via print array interface module 230.

Module 230 serves as an interface for engaging the plurality of electrical connections located on the array 240. These electrical connections provide the necessary signals for operating a plurality of micropumps, e.g., EHD micropumps (shown in FIGS. 4–7 below), which are employed to regulate the flow of fluids from the reservoirs within the array 240 onto a surface of the receptor 250. The interface 230, which is electrically connected with the controller 210 and the array 240, contains the necessary circuitry and connectors for selectively providing control signals from the controller to the EHD micropumps in the array 240.

Figure 3:
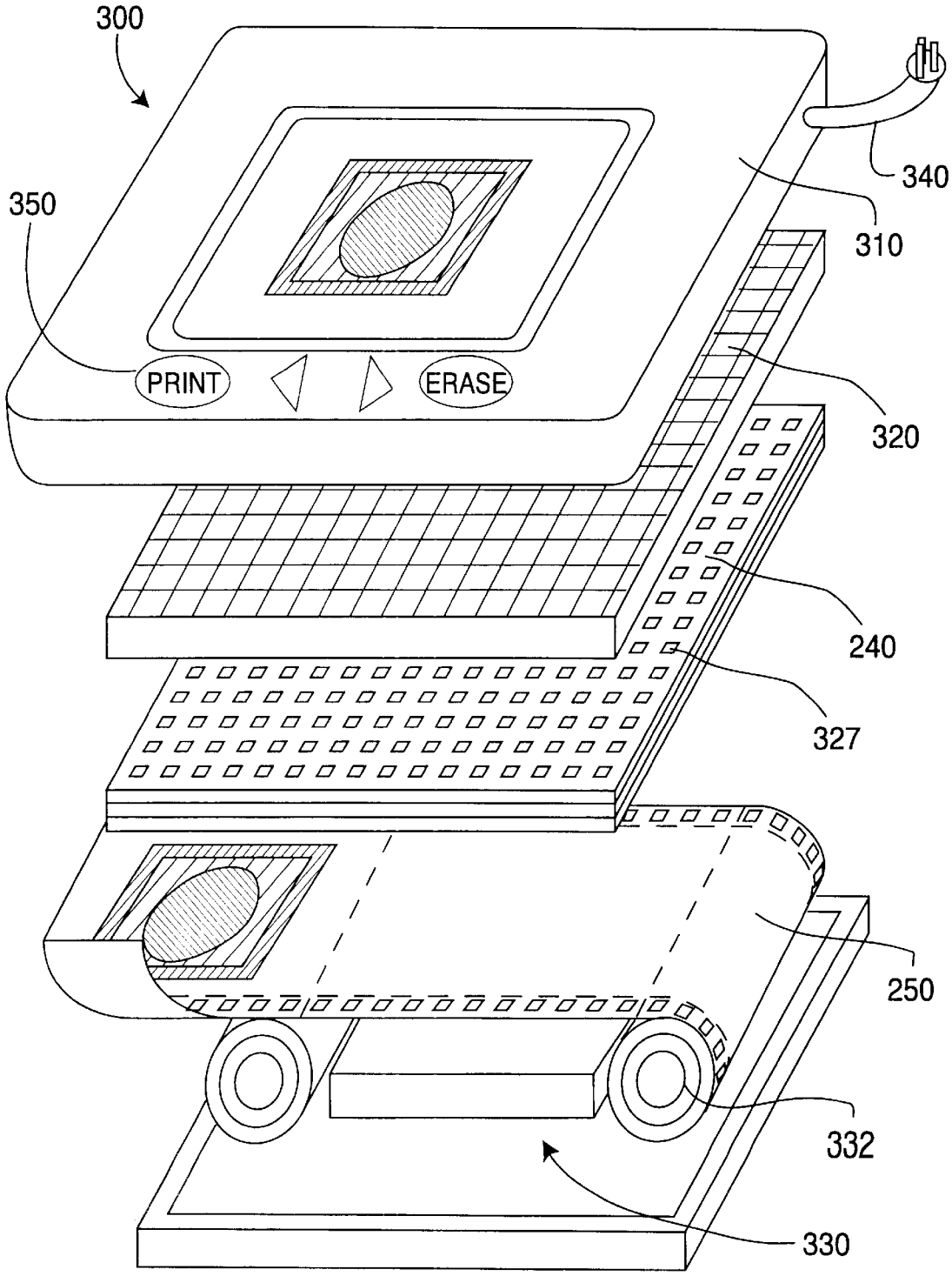
FIG. 3 illustrates one embodiment of a print array, which is incorporated within a portable printer.

FIG. 3 illustrates one embodiment of the array 240, which is incorporated within a portable printer 300. In this embodiment, the portable printer 300 may comprise the following devices: a display (e.g., a liquid crystal display310), a printer interface module 320, a printer array 240, a receptor support assembly 330, an interface connector 340 and various switches 350. The controller 210, memory 220 and a power source (e.g., batteries) are not shown in FIG. 3. Although the invention offers various advantages that promote its use in a portable printer, it should be understood that the invention is not so limited.

The interface connector 340 can be used to interface with an electronic photography device, e.g., an electronic camera. An electronic camera captures images as arrays of electrical charges using, for example, a CCD imager, and stores the images in the same way that a computer stores graphics. The stored images can be displayed on a computer monitor or television screen. The retained images are stored on computer-compatible memory devices that can be subsequently transferred to, processed by, and/or printed by computers or by a printer 300 as illustrated in FIG. 3.

The connector 340 passes the stored images from the camera to the memory 220 of the printer 300, where the stored images can be recalled and reviewed by the user. The memory 220 has a suitable storage capacity to receive a plurality of stored images. Thus, the printer 300 may comprise an optional display 310, which serves to display the stored images to the user. In addition, a plurality of illustrative function keys 350 are provided to allow the user to scroll forward and backward, print or erase a set of stored images.

To print a stored image, the control signals representative of the desired stored image are passed to the module 320. The module 320 serves as an interface for engaging the plurality of electrical connections or contacts 327 located on the array 240. These connections provide control signals to a plurality of micropumps which are employed to regulate the flow of fluids (ink or pigment) from the reservoirs within the array 240 to a location on the receptor surface, thereby forming the desired stored image on the surface of the receptor 250. Alternatively, the electrical connections or contacts 327 can be situated at the periphery of the print array. Embodiments of the interface module and corresponding control methods are described in U.S. Patent Application Ser. No. 08/939767 filed Sep. 29, 1998 with the title "Multi-Element Fluid Delivery Apparatus And Methods" which is hereby incorporated by reference.

Finally, FIG. 3 illustrates a receptor support assembly 330 that serves to support the receptor 250 against the array 240. Assembly 330 incorporates a pair of rollers 332 for advancing a roll of receptors with perforation. The perforation allows a "printed" receptor to be easily torn away from the roll of receptors.

The rollers also serve to apply pressure and align the receptor against the array 240, thereby causing the surface of the receptor to come into contact with the print array. Alternatively, the rollers may incorporate tracking teeth or guides (not shown) for engaging guide apertures (not shown) along the edges of the roll of receptors. Such tracking guides allow proper alignment of the receptor 250 with the array 240. These tracking guides are commercially available. In addition, optional perforation can be implemented along the guide apertures so that they can be removed from the printed receptor. Alternatively, the assembly 330 can be implemented using a spring loaded dispensing cartridge carrying a stack of receptors, e.g., similar to an instant film pack for instant cameras.

Figure 4:
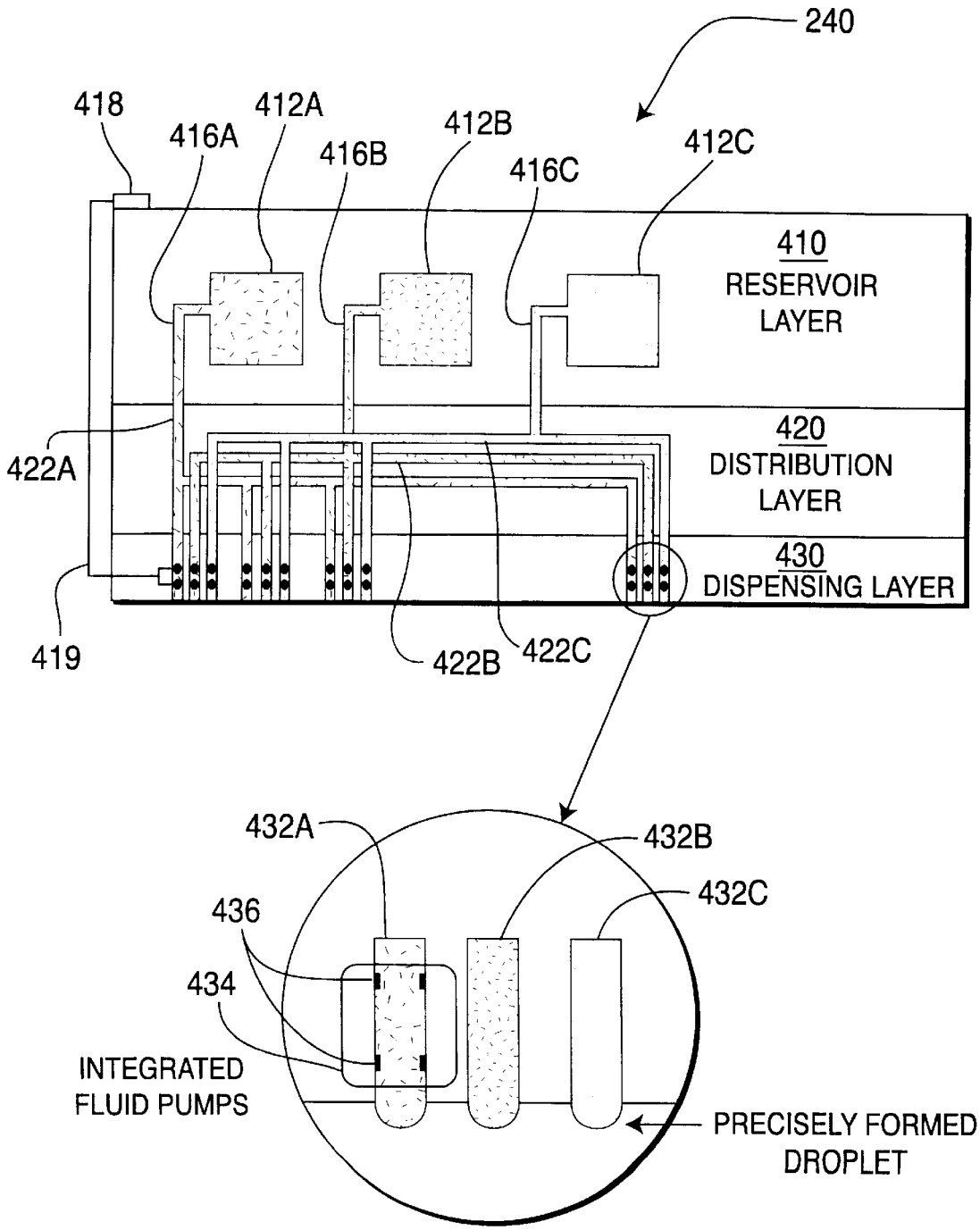
FIG. 4 is a sectional view of the a microfluidic print array.

FIG. 4 depicts the array 240, which is comprised of a high-density array of reservoirs, capillaries, fluid dispensing apertures, integrated micropumps, and integrated pump drivers. More specifically, the array 240 is a multilayer fluidic print array having reservoir(s) of pigment, connecting microchannels, EHD micropumps and dispensing orifices or apertures etched into a substrate. Such pumps and pumping methods are disclosed in U.S. Pat. No. 5,585,069 issued Dec. 17, 1996, in U.S. Pat. No. 5,630,351 issued Feb. 18, 1997, Patent Cooperation Treaty Application Ser. No. 95/14590 filed Nov. 9, 1995, and Patent Cooperation Treaty Application Ser. No. 95/14586 filed Nov. 9, 1995. The disclosure of each of these patents and patent applications is incorporated herein by reference.

In one embodiment, the array 240 comprises three distinct modules, layers or plates. It should be understood that each module or layer may comprise, in turn, sublayers or subplates as discussed below. Specifically, array 240 comprises a reservoir layer 410, a distribution layer 420 and a dispensing layer 430. The three layers are stacked one over the other and coupled together to form a liquid-tight seal. Preferably, the various layers are bonded or fused by thermal bonding or anodic bonding or other suitable bonding techniques.

The layers of the print array are preferably made from glass or a combination of glass and silicon. Other suitable materials include fused silica, quartz, plastics, or flexible elastomeric materials such as Corning "Sylgard 184". The selection of the material can be tailored for a particular type of fluid or implementation, e.g., various types of ink may exhibit different flow characteristics in a different material. For example, glass possesses insulating properties, which will permit the insertion of micropump electrodes in close proximity through the dispensing layer, thereby permitting the construction of a high density print array. Furthermore, since many organic solutions dissolve plastic, glass may also be suitable where the pigments are organic based.

The layers of the print array are suitably about 5 cm. by 7.5 cm. with a thickness of about 1 millimeter. The reservoirs, microchannels and orifices are finely and controllably etched or drilled in the layers using modified semiconductor techniques with a suitable chemical or laser etchant, e.g., wet chemical etching, reactive ion etching, or excimer laser drilling.

Figure 5:
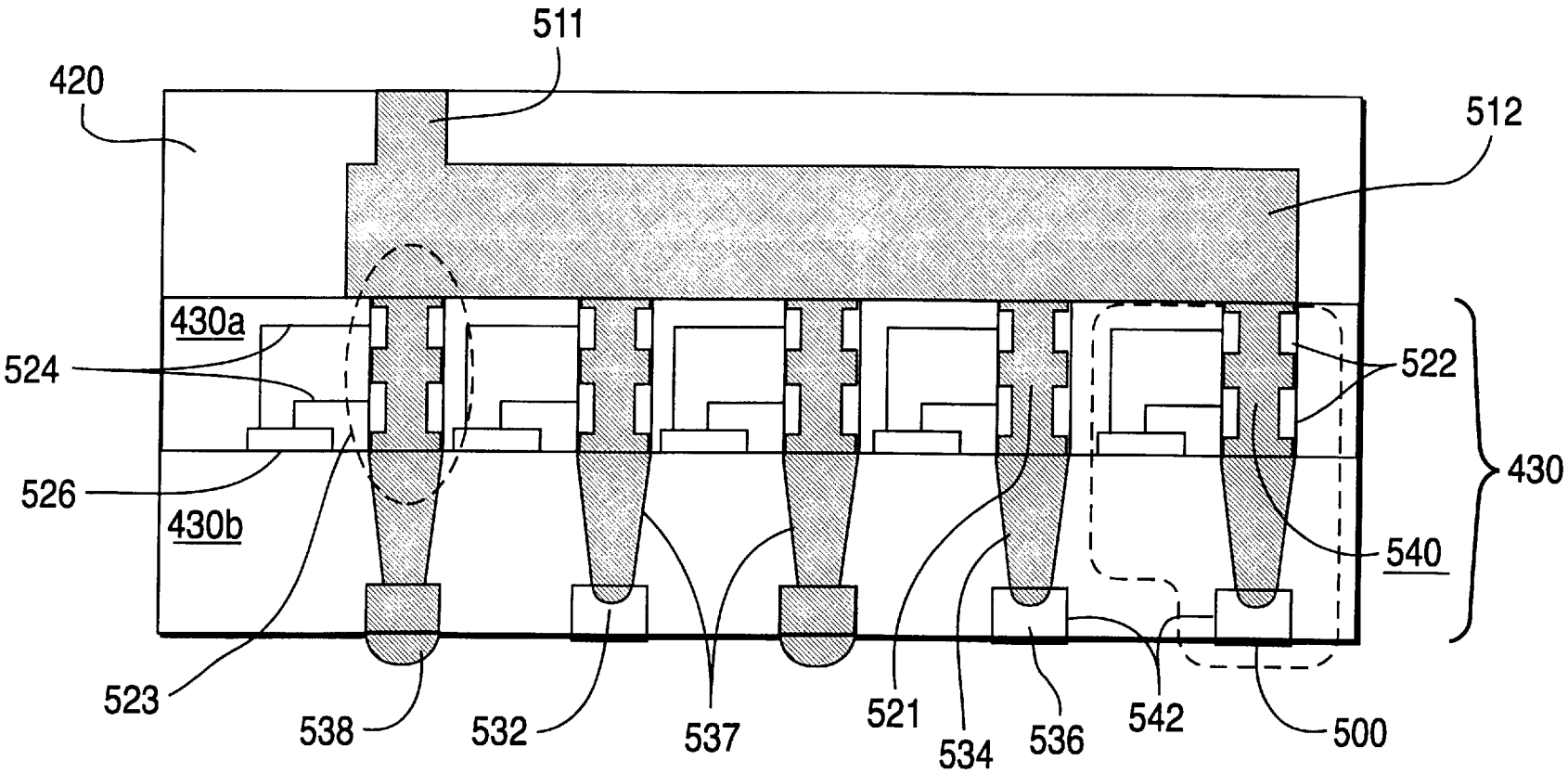
FIG. 5 is a sectional view of a distribution layer and the dispensing layer.
Figure 7:
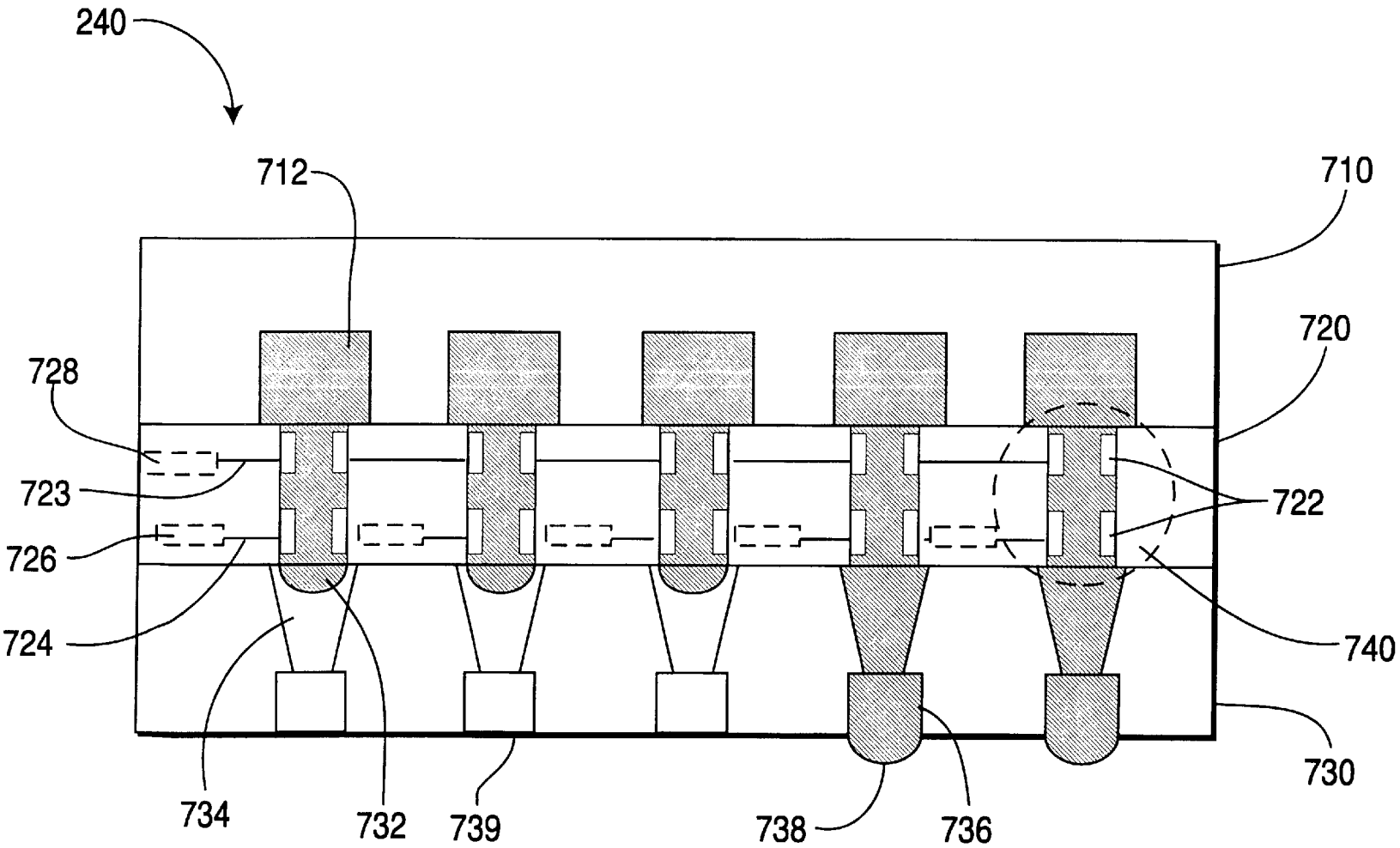
FIG. 7 illustrates various alternate embodiments of the print array.

The layer 410 comprises a plurality of prefilled reservoirs 412A–412C carrying one or more types of fluids, e.g., fluids with different pigments (color inks). In one embodiment, the fluid reservoir layer has the necessary reservoirs to house inks of red, green, blue, and optionally black (not shown), if desired. The reservoirs should be of sufficient volume to print a reasonable number of copies. These reservoirs would be factory-filled using specialized cartridge-filling machines designed for this purpose. The reservoir layer may contain an optional distribution system (416A–416C) which directs the fluids from the reservoirs to the distribution layer or, as shown in FIGS. 5 and 7, the reservoir layer can be implemented with only reservoirs, where the distribution system is confined within the layer 420.

Additionally, suitable coating, e.g., a hydrophobic seal can be applied to the reservoirs to implement precise droplet formation and to prevent leaching or cross contamination of fluids between reservoirs or to prevent chemical reaction of the stored fluids with the material of the reservoir itself. Examples of a hydrophobic coating includes fluorocarbon polymers such as Teflon TFE or FEP, and surface-polymerized silicones. Alternatively, the layer 410 may comprise a single reservoir (not shown) for carrying only one type of fluid, e.g., a black ink for printing gray-scaled images. In this embodiment, the cost and complexity of the print array can be significantly reduced, since only one reservoir is formed in the reservoir layer and the complexity of the distribution layer is also reduced.

Alternatively, the reservoir layer 410 may further incorporate an optional feed (not shown), which provides the ability to refill a depleted reservoir. For example, a detachable reservoir pack can be coupled to the array 240 or the printer system may incorporate a much larger reservoir for providing additional ink to the array 240.

Returning to FIG. 4, the layer 420 carries a distribution microchannel system (422A–422C). This system allows a set of centralized reservoirs 412A–412C to provide fluids to a plurality of locations, i.e., apertures on the dispensing layer 430 of the array 240. The layer 420 is made preferably from glass, a ceramic material or other material and is a three-dimensional fluid distribution system which enables the transfer of primary colors, e.g., red, green, blue (RGB) and optional black inks from the reservoirs to individual dispensing location without cross-contamination. A cross-section of such a system is illustrated in FIG. 4 where only red, green, and blue inks are shown. Microchannels connected to the red, green, and blue ink reservoirs distribute a single ink color to an entire row of dispensers located in the layer 430. In turn, micropumps 434 are used to activate the droplet formation at the exit of individual dispensers. FIG. 4 includes an enlarged section view of three dispensers 432A–432C carrying three different color inks. Each dispenser includes a fluid delivery element, e.g., a micropump 434 that comprises a pair of electrodes 436. The micropumps 434 are disposed within channels of capillary dimension, where the micropumps effect the movement of the fluids by applying an electric field to the fluids. The micropumps 434 are based on electrokinetic pumps, e.g., as disclosed by Dasgupta et al in Anal. Chem. 66, pp 1792–1798(1994) or other suitable pumps based on micro-electromechanical systems (MEMS) such as reported by Shoji et al in Electronics and Communications in Japan, Part 2, 70, pp 52–59 (1989). EHD micropumps are also disclosed in "A Micromachined Electrohydrodynamic EHI Pump", Sensors & Actuators 29, 159–168 (1991).

Although FIG. 4 illustrates the dispenser being implemented on a separate dispensing layer, it should be understood that dispensers or portions thereof, can be alternatively disposed within the layer 420. Namely, each dispenser refers to a small length of microchannel having a fluid delivery element and an aperture. The microchannel in the dispenser may have a particular structure. Thus, if the fluid delivery elements are implemented within the layer 420, the dispenser simply refers to a small length of microchannel with an aperture.

It should be understood that the EHD phenomenon involves various forces. Thus, the term EHD micropump as used herein includes micropumps that may operate under one or more forces, e.g., electrokinetic forces such as electrophoretic and electro-osmotic forces, Kelvin polarization force, dielectric force and electrostrictive force. More specifically, force density acting on a dielectric fluid can be expressed generally as:

$$F = qE + \vec{P}\cdot\nabla\vec{E} - \frac{1}{2}E^2\nabla\varepsilon + \nabla\left[\frac{1}{2}\rho\frac{\partial\varepsilon}{\partial\rho}E^2\right] \tag{1}$$

where, q=free space charge density

E=electric field

ϵ=permittivity

P=polarization vector

ρ=mass density.

Equation (1) can be viewed as comprising four (4) different forces, where:

$$qE \equiv \text{Coulomb force;}$$

$$\vec{P}\cdot\nabla\vec{E} \equiv \text{Kelvin polarization force;}$$

$$-\frac{1}{2}E^2\nabla\varepsilon \equiv \text{dielectric or Korteweg-Helmholz force; and}$$

$$\nabla\left[\frac{1}{2}\rho\frac{\partial\varepsilon}{\partial\rho}E^2\right] \equiv \text{electrostrictive force.}$$

In general, the Coulomb force is responsible for electrophoresis and electro-osmosis. Namely, electrophoresis occurs when a Coulomb force is applied to a particle or molecule that has a charge in the bulk of the fluid. Whereas, electro-osmosis occurs when a coulomb force is applied to a charge layer formed at a solid-liquid interface, e.g., a sleeve or tube of charges along the inside surface of a microchannel.

The Kelvin polarization force generally exists where the electric field is nonuniform. As such, these nonuniformities generally exist at the edges of the electrodes, e.g., the periphery of two plates.

The dielectric or Korteweg-Helmholz force generally exists in the presence of a nonuniform medium, e.g., pigment dispersed in a fluid, while the electrostrictive force generally exists when the mass density changes, e.g., a compressible fluid. A detailed description of these forces is disclosed in *Continuum Electromechanic*, by James R. Melcher (1981) MIT Press.

Thus, the contribution from these forces can vary significantly from implementation to implementation, but micropumps operating under any of these forces are considered EHD micropumps. Furthermore, it should be understood that equation (1) only accounts for the EHD phenomenon and does not account for other factors such as fluid dynamics. Thus, the invention can be modified to account for effects from different EHD micropump configurations, different fluid characteristics and different materials used in the formation of the present print array. To illustrate, if the micropump electrodes are separated farther apart, e.g., typically above 500 $\mu$m, and the fluid has free charges, e.g., an electrolyte solution, electro-osmotic forces contribute to a greater extent in the movement of the fluid than other forces. In contrast, if the pump electrodes are positioned closer, e.g., typically between 200–500 $\mu$m, and the fluid does not have the charges, e.g., organic solvents like THF, forces acting on injected or induced charges contribute to the movement of the fluid.

Thus, since Coulomb polarization, dielectric or electrostrictive forces are typically present to some extent, the present EHD micropump should be interpreted as electrofluidic pumps operating under one or all of these forces. Thus, depending on the behavior and composition of the fluids, suitable EHD micropumps can be selected and implemented to satisfy the requirement of a particular application that uses the present print array.

In fact, micropumps may operate under other phenomena, other than electrohydrodynamics, e.g., "electro-wetting". A description of the electro-wetting phenomenon has been given by G. Beni et al., Appl. Phys. Lett. 40 (10), May 15, 1982 and by G. Beni et al., J. Appl. Phys. 52(10), October 1981.

Returning to FIG. 4, application of an AC or DC electrical signal across a region of the fluid via the pump electrodes causes fluid to flow towards the dispenser. Each dispenser is addressable via electrical connections 419 and 418. These electrical connections can be formed by depositing a conductive material onto the print array using traditional methods.

FIG. 5 illustrates a detailed sectional view of the distribution layer 420 and the dispensing layer 430 where a single microchannel 512 distributing a fluid to a plurality of dispensers 500. Layer 420 comprises at least one feed 511 for receiving fluid from a reservoir (not shown). In one embodiment, the layer 430 comprises a plurality of dispensers 500 implemented on two or more sublayers, 430*a* and 430*b*. Each dispenser 500 may comprise an micropump 523, a driver 526 and a dispensing channel 540. The micropump 523 comprises a set of electrodes 522, which are coupled to the driver 526 via electrical connections 524. The driver 526 is electrically coupled to the printer interface module as discussed above. In this manner, the controller 210 is allowed to control the activation of the micropumps 523 for moving the fluids in the prefilled reservoirs onto the receptor surface.

In FIG. 5, each of the dispensers 500 in the layer 430 includes a channel 540, that is comprised of three separate microchannel sections 521, 534 and 536. Section 521 is a substantially straight microchannel that carries the electrodes 522. Section 534 extends from section 521 and has a tapered end. In turn, section 536 which extends from section 534, has an opening that is designed to be slightly larger than that of the tapered end of section 534. This enlargement serves as a capillary break or capillary stop to prohibit the inadvertent flow of fluids from the section 534 into section 536. Namely, when a fluid is within a microchannel of capillary dimension, a meniscus 532 is typically formed. By employing an opening that is larger than the microchannel exit, the capillary force is sufficiently strong to stop the fluid from exiting the microchannel, thereby avoiding inadvertent discharge of fluid onto the receptor surface.

Optionally, using traditional masking technique, the sides 537 and 542 can be treated with a coating or seal. A suitable coating, e.g., a hydrophobic seal can be applied to the sides to minimize lateral diffusion and/or to assist the micropump in stopping the flow of fluid. Depending on the material used, lateral diffusion may cause cross contamination between different reservoir/microchannel systems or may allow a fluid to inadvertently permeate to an unintended location on the surface of the receptor.

Figure 6:
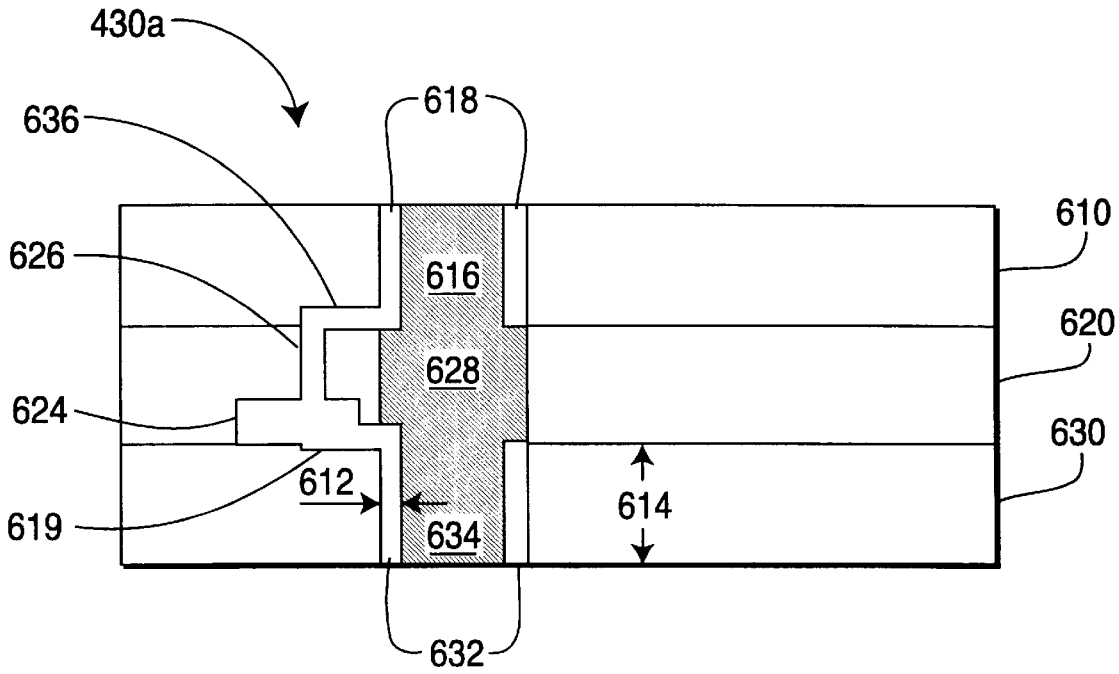
FIG. 6 illustrates one detailed embodiment of the dispensing layer.

In FIG. 6 the sublayer 430*a* includes the section 521 of the dispensing layer having three layers, 610, 620 and 630. The thickness 614 of these layers is suitably about 100–1000 microns, but is preferably set at about 500 microns. Traditional masking and etching techniques are used to form the section 521, the micropumps 523 and their associated electrical connections. Within layer 610, a first electrode 618 is deposited along the side of a first portion 616 of the microchannel 521. The electrode 618 can be implemented in a number of different shapes and configurations. Preferably, the electrode 618 consists of a conductive material deposited along the portion 616 of the microchannel, where the resulting electrode has the general shape of a ring. The thickness 612 of the ring electrode is about 5 and 25 microns with a length between about 100–500 microns. Alternatively, the micropump electrodes may consist of an electrical conduit of electroplated gold that terminates as a "projection" (not shown). The length of the electrode is between about 10 and 50 microns with a diameter of between about 50 and 100 microns. Thus, unlike the ring electrodes, the projection electrodes only extend from one side of the microchannel, whereas the ring electrodes are concentric with the microchannel 636 located on the bottom of layer 610 and can be deposited onto layer 610 or onto layer 620.

Layer 620 comprises a second portion 628 of the microchannel 521 and a driver 624. An electrical connection 626 is deposited onto layer 620, to couple the driver 624 to the electrical connection 636. In one embodiment, the driver is implemented using thin film transistors which are well known in the art.

Within layer 630, a second electrode 632 is deposited along the side of a third portion 634 of the microchannel section 521. The portions, 616, 628 and 632 collectively form the microchannel section 521. Similar to layer 610, layer 630 includes an electrical connection 619 serves to couple the second electrode 632 to the driver 624. Thus, the driver 624 is coupled to the first and second micropump electrodes 618 and 632 and is capable of receiving a control signal from the controller 210 via module 230 and activates the micropump 523 to cause fluid to flow from the reservoir to the receptor surface.

In FIG. 6 three layers 610, 620, and 630 have holes drilled to the same size and location on each layer so they line up as shown. Layers 610 and 630 need a conductive coating inside the holes, where the coating in 610 forms one electrode, and the coating in 630 forms the other. This is accomplished by depositing onto the surface of the layer and the interior of the holes a thin layer of between about 0.01 and 0.1 microns of a metal such as Cr, Au, Pt, Al using sputtering or evaporating techniques. Using standard photolithography, the surface of the plate is masked while the holes are exposed, then holes are electroplated with metal. The mask is removed, and the thin surface metal is removed by ion beam milling. The resulting structure has metal only inside the holes and nowhere else on the layer. Planar metal contacts 619 and 636 could be fabricated by first etching a shallow recess between about 5 and 10 microns in the layer. Thin film metal is deposited into the recess followed by electroplating metal several microns-thick, and then the mask would be removed. A recessed structure enables a planar contact without interfering with the permanent bonding of layers. Alternatively, solder bumps and solder reflow techniques could be used. Alternatively, thin-film conductive silicon could be used in place of metal in 619, 636, 618 and 632. Metal feedthroughs 626 could be fabricated as previously described or, combined with planar metal contact 636, could be simultaneously formed by thin-film depositing metal or silicon in the recess and through the hole 626 to from a continuous contact to the driver 624. Fabrication of the drivers 624 is based on well-established techniques. These drivers could be located on the top of the cassette, rather than embedded or recessed as shown, to simplify the overall construction with contact from the drivers to the electrodes made through feedthroughs.

FIG. 7 illustrates other embodiments of the array 240. First, the configuration of the drivers on the print array can be implemented using a linear array of drivers, e.g., one driver directly addressing one pump. However, for a large print array, many drivers are needed, and arranging the drivers in a two-dimensional matrix pattern is preferable. The two-dimensional matrix of drivers can be accessed using a "grid like" printer interface module 320 as illustrated in FIG. 3. The driver access or connection points are located at the intersections between the vertical and horizontal lines.

For a large print array numerous drivers and driver access points are required. For example, a print array having 1000 surface locations requires 1000 drivers and 1000 driver access points. Thus, in one embodiment, the drivers 726 and 728 are implemented along the periphery of the array 240 as shown dashed lines. Namely, electrical connection 724 for all micropumps in a row are coupled to a single driver 726, while all micropumps in a column are coupled to a single driver 728 via electrical connection 723. It should be noted that only one micropump 740 with electrodes 722 is illustrated per column. Various methods of addressing these drivers in a matrix manner are disclosed in U.S. Patent Application Ser. No. 08/939,767. To reduce the cost and complexity of the print array, the drivers can be implemented on the printer 200 instead of the array 240 within the module 230, such that the drivers are only in electrical communication with the electrical connections 723 and 724 without having to be physically located on the array 240.

FIG. 7 illustrates a plurality of dedicated reservoirs 712 on reservoir layer 710. These reservoirs reduce cost and complexity by reducing the complexity of the distribution layer 720 since fewer number of microchannels are implemented, while the number of reservoirs is increased. It is generally more difficult to form a complex set of overlapping microchannels than to form additional reservoirs.

Alternatively a second capillary break is implemented in section 734, thereby causing the formation of a meniscus 732 in layer 730. This additional capillary break increases the ability to finely control the flow of the fluid from each dispenser. Alternatively section 736 can be coupled directly to the microchannel in distribution layer 720, thereby allowing a droplet 738 to be formed at opening 739 when the micropump 740 is activated.

Figure 8:
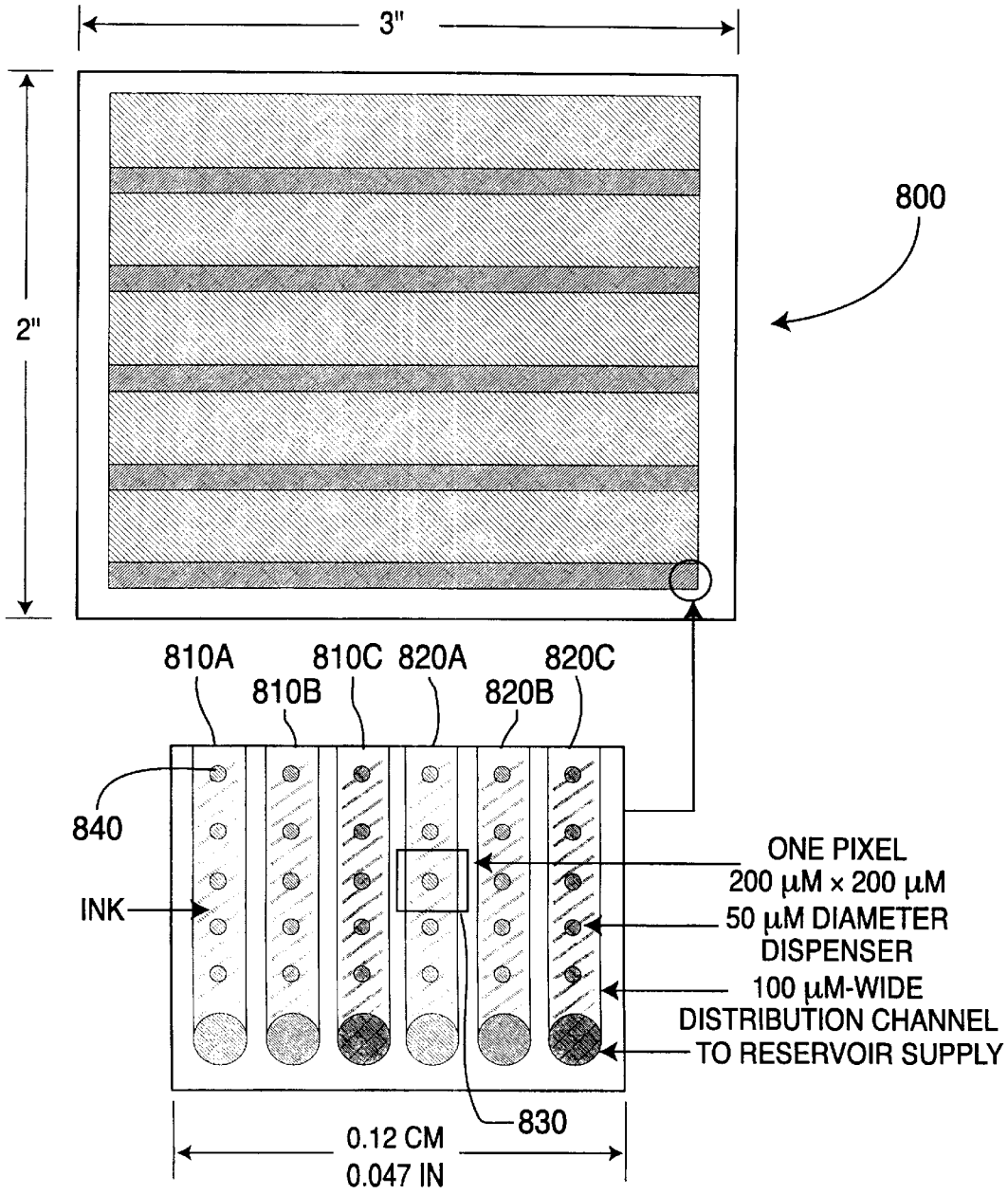
FIG. 8 is a planar view of the distribution circuit just above the dispensers.

FIG. 8 illustrates a planar view 800 of the distribution circuit with an expanded view of the dispensers 840. In one embodiment, the droplet dispensers 840 are implemented as a two-dimensional planar array in which each column 810A–810C and 820A–820C is a linear array which dispenses only a single color of ink (e.g., red 810A and 820A, green 810B and 820B, or blue 810C and 820C) to all the pixels in that column. An enlarged view of this configuration is shown in the expanded view of FIG. 8. The pixel size 830 is about 200×200 microns, which yields a density of $10^4$ pixels per square inch. Each pixel dispenser 840 is about 50 microns in diameter. Droplets must have a volume sufficient to cover the entire 200 microns$^2$ pixel by diffusing over this region, with the appropriate density to yield the desired color. To print in any given pixel, the array 240 makes three (3) sequential moves, dispensing and then blotting red, green, and blue droplets of the appropriate volume on the same pixel 830 to mix on the receptor and create the desired color. An about 5 cm×7.5 cm dispensing array is shown in FIG. 8, but it should be understood that the array can be implemented in any size. To print a about 5 cm×7.5 cm image, the print array needs to make only three sequential moving and blotting steps.

To make a larger print, the print array must make the corresponding number of moves, with the appropriate addressing to each dispenser to achieve the desired colors in pixels to be printed, as well as pixels already printed. This could be achieved by (i) turning "off" the dispensers that land on completed pixels; or by (ii) dispensing smaller droplets such that multiple RGB move and blot steps are needed to complete a pixel, and the number of steps corresponds to the overall moves needed to complete the entire print.

Alternatively, the pixel size is approximately the size of the dispenser. The primary difference is in the density of printed pixels, and the number of print array moves required to print the pixels. Here, dispensers 840 are also on the order of 50 microns in diameter, and on 200 microns centers. However, smaller droplet volumes and smaller step sizes enable a much higher resolution. Furthermore, in the first embodiment, the receptor, e.g., paper or film, must be designed to spread the droplets of ink over the entire pixel, whereas in this embodiment, no spreading is preferred, since the dispenser size is nearly the same size as the pixel. The preferred embodiment depends on which type of paper or film is employed.

Figure 9:
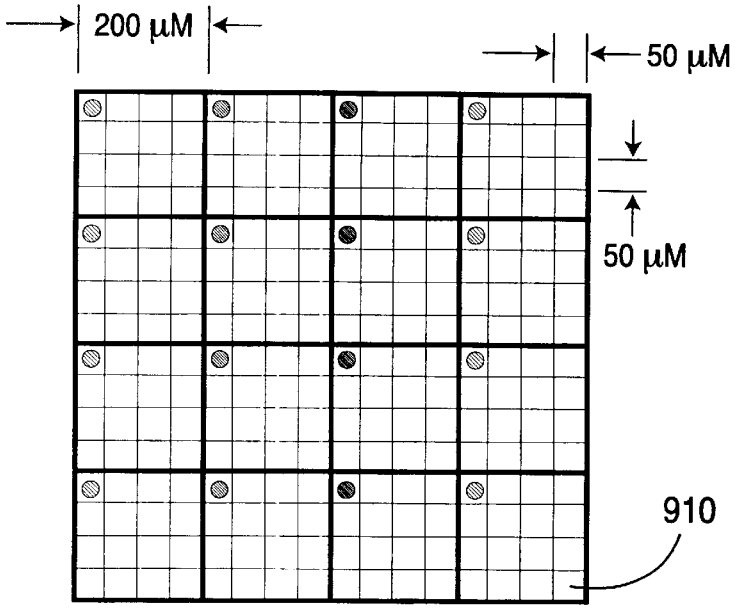
FIG. 9 illustrates a $1.6\times10^5$ pixels/sq. in. density (400 DPI) superimposed on a $10^4$ pixel density (100 DPI)
Figure 10:
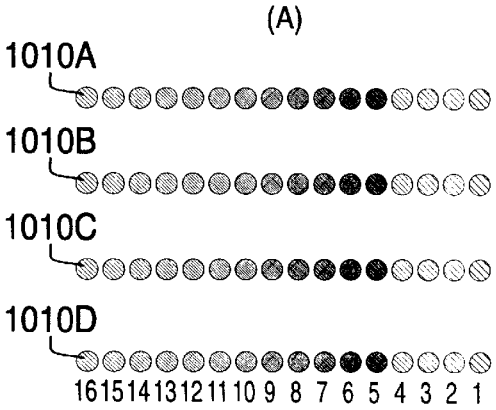
FIG. 10 illustrates the color pattern of the first four printing steps based on the density of FIG. 9, where no mixing of inks occurs in these first four steps.

More specifically, FIG. 9 illustrates a $1.6\times10^5$ pixels/sq. in. density (400 DPI) configuration superimposed on a $10^4$ pixel density (100 DPI) configuration, assuming a fluid dispensing area 910 of 50 microns. The first four printing steps are shown in FIG. 10, where no mixing of inks occurs in the first four steps. Namely, for each row 1010A–D, pixel locations 1–4 and 13–16 are red, pixel locations 5–8 are blue and pixel locations 9–12 are green.

Figure 11:
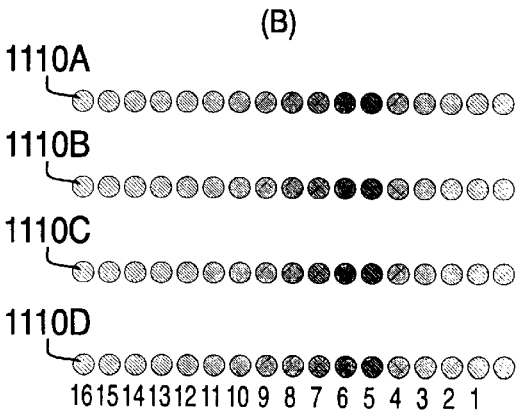
FIG. 11 illustrates a different color where some mixing occurred on the fifth step.

FIG. 11 illustrates some mixing where on the fifth step, a first red pixel is mixed with a last green pixel (e.g., pixel location 12 having already received a green droplet, again receives a red droplet), for a print array moving towards the right. Twelve sequential horizontal steps are required to mix RGB in each pixel. This sequence is repeated three more time to complete the printing in the vertical direction, i.e., filling the spaces between the rows 1110A–1110D. Each step has a center to center spacing of 50 microns, and for the sake of illustration, the droplet from every dispenser is assumed to be of equal volume. For example, equal parts of red and blue combine to form the color purple, as indicated by the $5^{th}$ pixel from the right in FIG. 11. Droplet dispensers on the leading and trailing edges of the print can be turned off to eliminate pixels, which are not part of the desired image. High resolution images, known as megapixel resolution ($10^6$ pixels/sq. in., or 1000 DPI) can be achieved by reducing the dispenser diameter 910 to 20 microns, and increasing the number of steps per horizontal line to 30. Integrated EHD pumps are used to activate the droplet formation at the exit of the dispenser. The length of pumping time is correlated with the droplet size. The red, green and blue droplet sizes are scaled according to the desired color in a given pixel.

Figure 12:
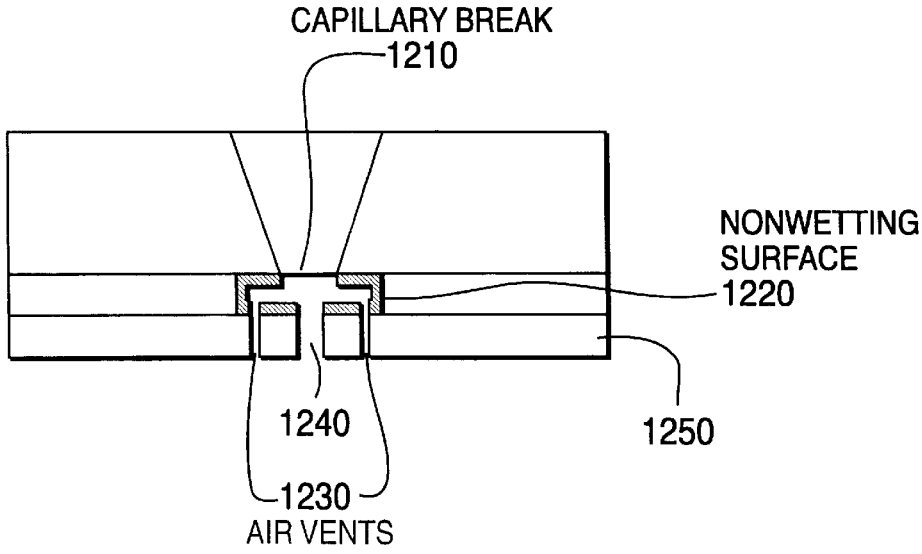
FIG. 12 is a sectional view of an alternate embodiment to the droplet dispenser.

FIG. 12 illustrates a sectional view of an alternate to the dispenser 1200 for a single pixel. An integrated passive valve, discussed above as a capillary break 1210, prevents the fluid from flowing past the region indicated by "capillary break" or "capillary stop". To commence fluid flow, micropumps are activated with sufficient head pressure to force the fluid over the capillary stop. The droplet volume is formed in proportion to the length of pumping time. Inks can be characterized such that a known pumping time yields a known droplet size. When the desired droplet sizes are achieved, the micropumps are turned off, and the paper is brought into contact with the droplets. The paper absorbs the fluid droplets up to the exit of the capillary break.

Next, a mechanism is required to prevent the fluid from continuing to flow beyond the desired droplet size while in contact with the paper. Mechanisms to achieve this include, but are not limited to the use of reverse EHD pumping to create a fluid "back flow" and/or the use of a nonwetting surface 1220, e.g., a hydrophobic coating, at the exit of the capillary break.

In fact, an optional layer 1250 can be overlaid over the dispensing layer. This additional layer may incorporate air vents 1230 which allow air to freely flow into the capillary break area to allow the proper termination of fluid flow. Namely, as the droplet is absorbed from the aperture 1240, air is allow to flow into the capillary break area, functioning like pincers to terminate the fluid flow.

Figure 13:
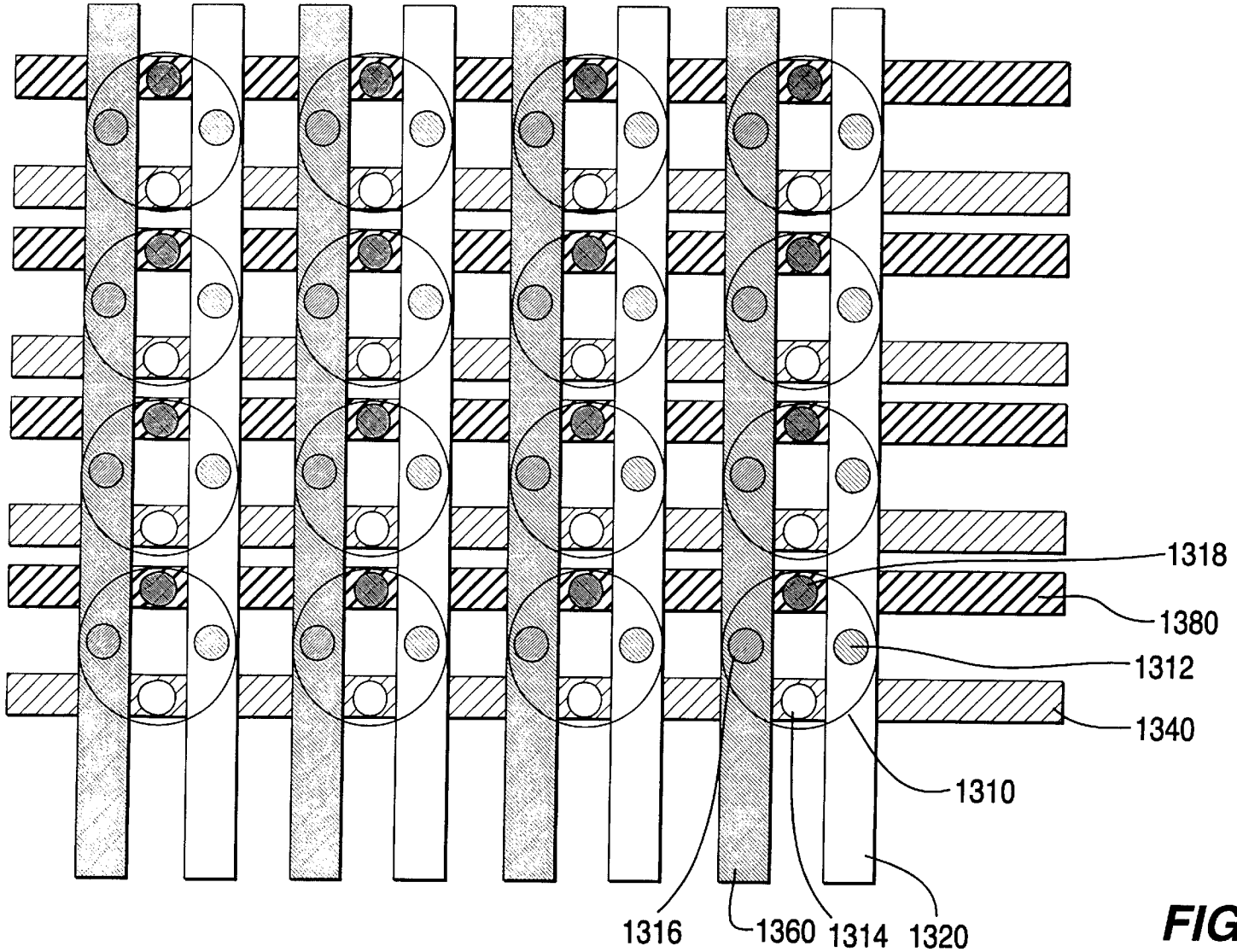
FIG. 13 illustrates another embodiment showing a planar view of the distribution circuit just above the dispensers.

FIG. 13 a planar view 1300 of the distribution circuit just above the dispensers is shown. In this embodiment, the distribution circuit has a plurality of designated surface locations 1310 which can be representative of pixels. Each location 1310 has a plurality of dispensers 1312, 1314, 1316, and 1318 which serve to provide a plurality of fluids to specific locations. Although four dispensers are shown, it should be understood that any number of dispensers can be employed depending on the requirement of a particular application. The plurality of dispensers 1312, 1314, 1316, and 1318 are coupled to a plurality of microchannels 1320, 1340, 1360, and 1380 respectively. These microchannels serve to provide fluids from a plurality of reservoirs to a location 1310. It should be understood that a plurality of dedicated reservoirs can be implemented instead for each surface location, thereby avoiding the need to provide a complex system of distribution channels.

FIG. 13 illustrates an important aspect of the print array, which is the ability to deliver a plurality of different color inks to a common location on the surface of the receptor. This ability allows color images to be printed without moving the print array. More specifically, each of the plurality of microchannels 1320, 1340, 1360, and 1380 can supply one of three primary colors, e.g., red, green and blue (RGB) or cyan, magenta and yellow (CMY, necessary to generate the full spectrum of visible colors. The fourth microchannel can optionally provide the color black. By injecting varying degrees of the fluids carrying pigments of the primary colors, each pixel can be controlled to produce a desired color to form a color image. The amount of various fluids to be introduced into a specific location can be controlled by the micropump within each microchannel. One method to implement such accurate dispensing of small amounts of fluid is disclosed in U.S. Patent Application Ser. No. 08/939,767.

Figure 14:
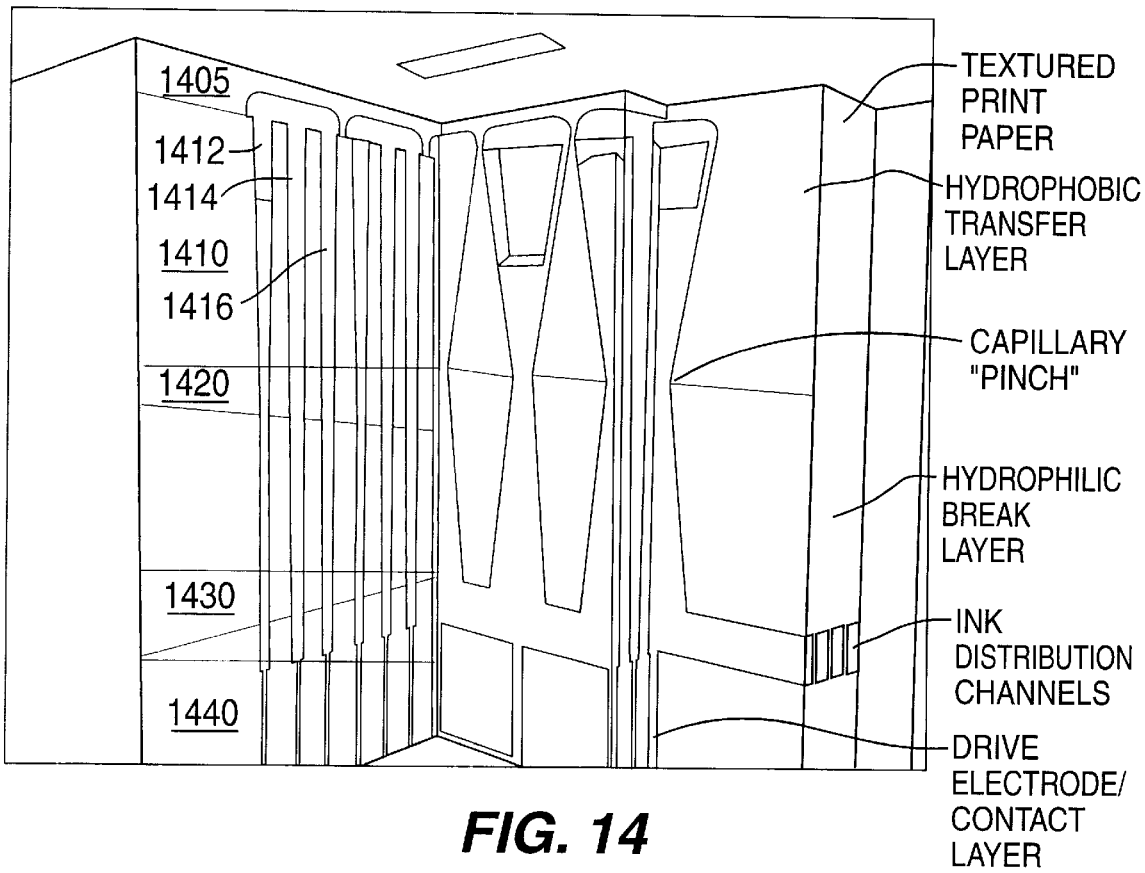
FIG. 14 illustrates an alternate embodiment of the print array.
Figure 15:
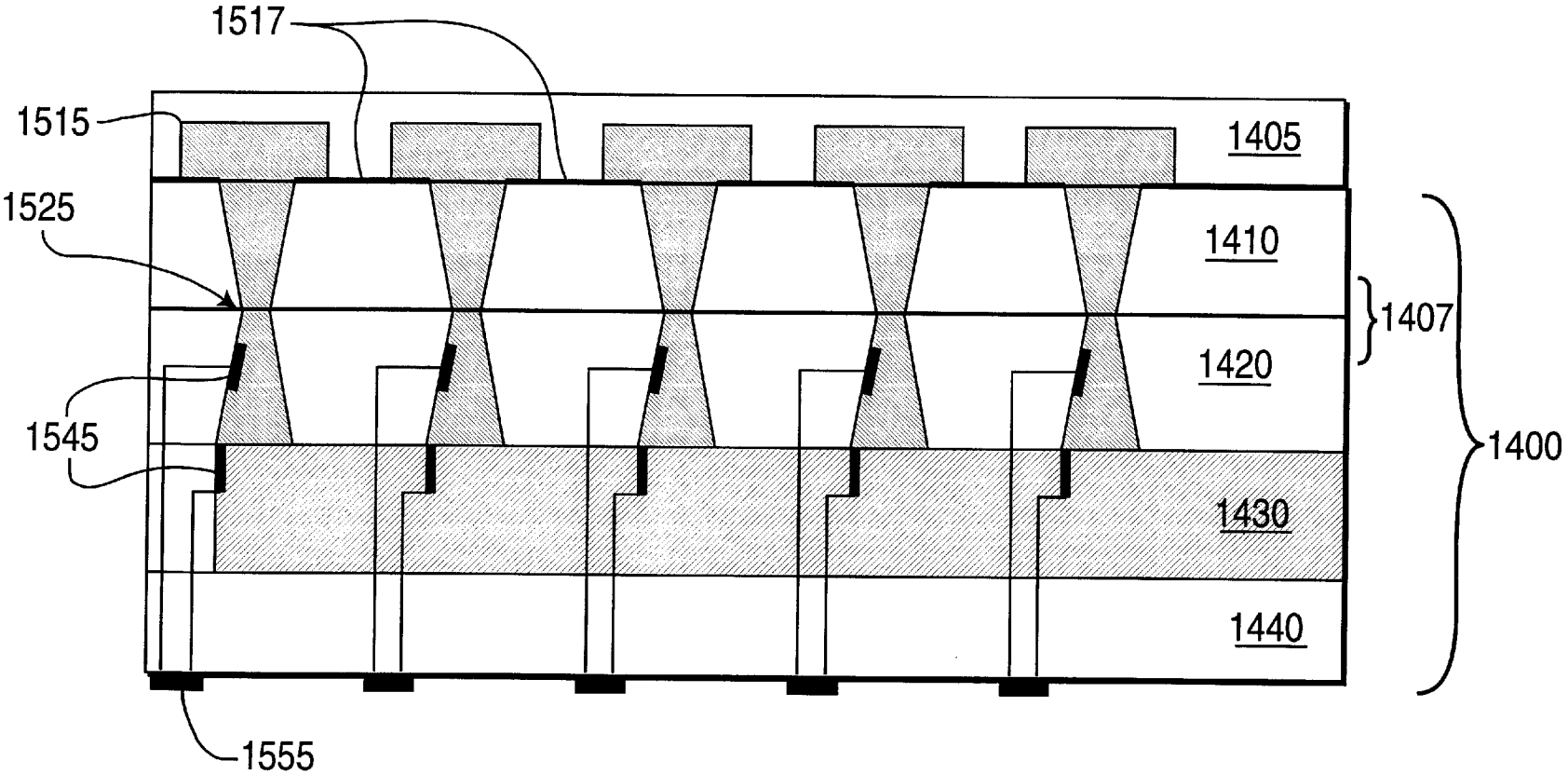
FIG. 15 is a sectional view of the alternate print array of FIG. 14.

FIG. 14 illustrates a cut-out isometric view of an alternate embodiment of the present print array, while FIG. 15 illustrates a sectional view of this alternate embodiment. Print array 1400 comprises a dispensing layer 1407, a distribution layer 1430 and a contact layer 1440. More specifically, the dispensing layer 1407 incorporates a hydrophobic sublayer 1410 and a hydrophilic sublayer 1420 which is separated by a capillary pinch 1525. The words hydrophobic layer or sublayer as used here mean a layer having a non-wetting surface with respect to a particular fluid under consideration and not to water. The words hydrophilic layer or sublayer as used here mean a layer having a wetting surface with respect to a particular fluid under consideration and not to water. The terms "wetting" and "non-wetting" refer to a measure of the affinity of a fluid to a surface. This measure can be viewed as a measure of surface tension, e.g., the shape of a droplet of fluid on a surface (i.e., contact angle of the droplet to the surface) or the shape of a meniscus within a capillary channel (i.e., convex or concave). Thus, a surface may be non-wetting with respect to one fluid, but may also be wetting with respect to another fluid.

The purpose of employing these two different sublayers is that when sufficient fluid in the hydrophobic sublayer 1410 has been dispensed, the hydrophobic nature of sublayer 1410 assists the fluid to retract back into the array, e.g., back to the capillary pinch 1525 when the micropump driving the fluid is deactivated or reversed. Namely, the capillary force associated with the "plug" of fluid within sublayer 1410 is reduced through the use of sublayer 1410, thereby allowing the fluid to more easily retract back into the array and return to a non-dispensing state.

The capillary pinch 1525 (between about 50 and 100 microns) at the juncture between the sublayer 1410 and sublayer 1420 provides an additional mechanism to enhance the control of the movement of the fluid in the dispensing layer 1407. The capillary force can be affected at regions where the angle of the surrounding walls of the channel is suddenly changed, e.g., from a substantially straight surface to a substantially perpendicular (e.g., 90°) surface as in the case of a capillary break. These changes in the channel walls often reduce the capillary force, thereby providing a point in the channel where it is likely for the fluid to reach an equilibrium state, e.g., a non-dispensing state. As such, the capillary pinch provides a natural location in the layer 1407 for the plug of fluid to retract to once dispensing is completed. This capillary pinch 1525 also assists in the dispensing of the fluid where the control signals are modulated as discussed below. It should be understood that the size of the capillary pinch can be adjusted for a particular application or simply omitted Again, the sublayers 1410 and 1420 can be implemented as discussed above through the use of coatings or membranes. It should be noted that the sublayer 1420 does not imply that fluid is allowed to diffuse through this layer, but that fluid is attracted to the walls of the microchannels within the sublayer 1420.

Alternatively, the sublayer 1420 may not even require a hydrophilic or hydrophobic coating. The hydrophilic nature of sublayer 1420 can be simply a measure of affinity toward fluid as compared to the sublayer 1410. Namely, sublayer 1420 can simply be "more hydrophilic" than sublayer 1410. As such, the sublayer 1420 can be implemented using a material that is more hydrophilic than the material used for the sublayer 1410, thereby omitting the need to apply a coating.

The print array 1400 further incorporates a distribution layer 1430 and an optional contact layer 1440. By applying a difference of potential via contact 1555, the electrodes 1545 affect the movement of the fluids in the print array and onto the paper 1405. As discussed above, the contacts can be implemented on the periphery of the print array, if desired. Additionally, although the electrodes 1545 are illustrated as disposed within the sublayer 1420 and layer 1430, it should be understood that these electrodes can be implemented in other configurations or locations, e.g., both electrodes (ring electrodes or pin electrodes) disposed on the sublayer 1420, and so on. Finally, the control signals that are applied to the contacts 1555 can be implemented as a modulating signal, such that the "plug" of fluid within the sublayer 1410 rises and falls in accordance with the frequency of the control signals.

The invention includes a method of transferring precise volumes of fluid to a receiving receptor. More specifically, control signals that are applied to fluidic arrays can be modulated, such that each dispenser of a fluidic array, oscillates a plug of fluid in accordance with the frequency of the control signals. The oscillation causes the plug of fluid to make contact with the receptor to transfer a precise amount of fluid. This method of dispensing fluid is referred to as "electronic fluid modulation" (EFM). For example, EFM allows each "plug" of fluid within the hydrophobic sublayer 1410 of array 1400 to make contact with the paper 1405 in accordance with the frequency of the control signal. The frequency of the control signals can be selectively altered to control the amount of fluids dispensed onto the paper 1405.

Preferably, the control signal is a square wave having a frequency of between about 10 and 30 Hertz. However, it should be understood that the frequency of the control signal can be modified to account for different pixel sizes, fluid dynamics and so on. In fact, the control signal can be a sine wave or a nonuniform signal wave.

Figure 16:
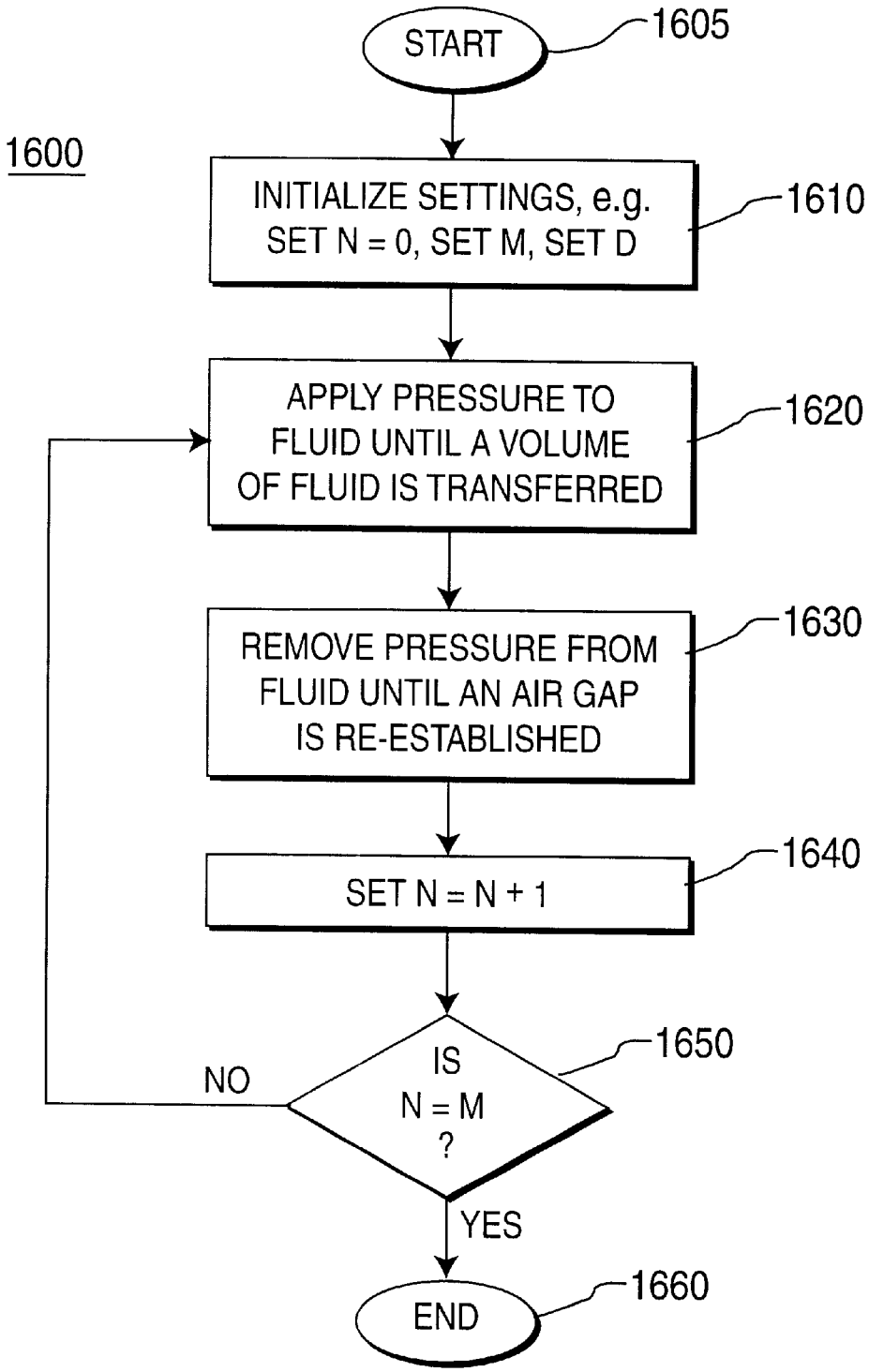
FIG. 16 is a flowchart of a method for transferring precise volumes of fluid to a receiving receptor.

FIG. 16 illustrates a flowchart of a method 1600 for employing electronic fluid modulation to transfer precise volumes of fluid to a receptor. Correspondingly, FIGS. 18–22 illustrate a sequence of sectional views of a plug of fluid within a fluidic array at varying stages in response to EFM. More specifically, FIGS. 18–22 show a sequence of illustrations that describe one cycle of the fluid transfer in accordance with electronic fluid modulation. FIGS. 18–22 only illustrate a portion of a fluidic array 1800, e.g., a dispensing layer having a set of sublayers 1810 1820 and 1830 with a pair of electrodes 1840 (e.g., a silicon sublayer followed by a glass sublayer and then followed by a silicon sublayer). As such, array 1800 should be interpreted broadly as illustrating the operation of EFM within the various fluidic arrays.

Method 1600 starts in step 1605 and proceeds to step 1610 where various settings are initialized. For precise fluid volume transfer, it is necessary to carefully control the interaction of the fluid with the receptor (e.g., paper, other media or one or more reaction cells as used in combinatorial chemistry or chemical synthesis). Namely, the amount of fluid that is transferred to the receptor depends on a number of parameters such as the time of contact, the cross section of the contact area, the absorbency of the receptor, the fluid characteristics and the like. These parameters can be determined for a particular fluid type and receptor, such that it is possible to correlate a volume of transferred fluid with a time or duration of contact. Such fluid volume transfer information can be experimentally deduced or provided by a paper manufacturer for a particular type of fluid.

More specifically, using such fluid volume transfer information, method 1600 in step 1610 can then set a variable D to represent a duration of contact, e.g., 0.04 second of contact between the fluid and the receptor and a variable M to represent the frequency or a predefined number of cycles of contact, e.g., 10 cycles. Therefore, M×D represents the total volume of fluid transfer. By proper selection of M and D, it is possible to deposit a precise amount of fluid onto a receptor, thereby allowing features such as gray scale and/or color printing. In step 1610, method 1600 can also set the variable N to zero, where the variable N serves as a counter.

Figure 18:
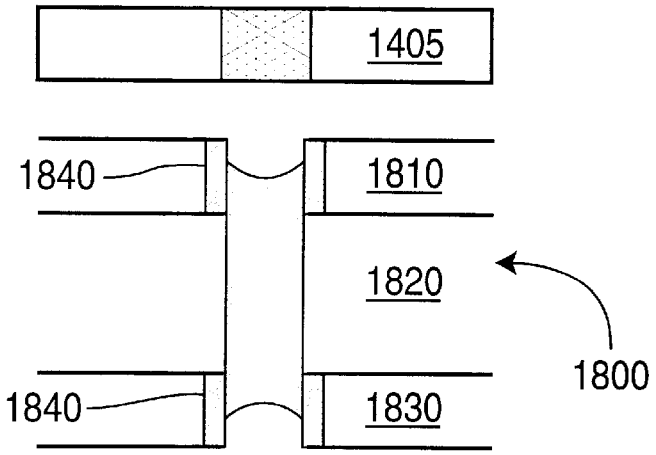
FIG. 18 is a sectional view of a plug of fluid at a first stage before the application of electronic fluid modulation.
Figure 19:
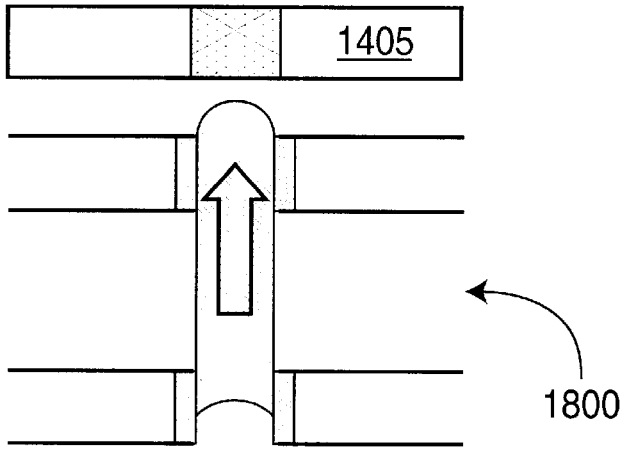
FIG. 19 is a sectional view of a plug of fluid at a second stage in response to the application of electronic fluid modulation.
Figure 20:
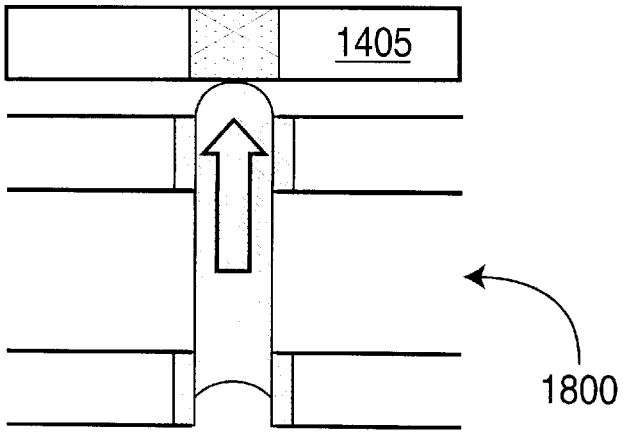
FIG. 20 is a sectional view of a plug of fluid at a third stage in response to the application of electronic fluid modulation.
Figure 21:
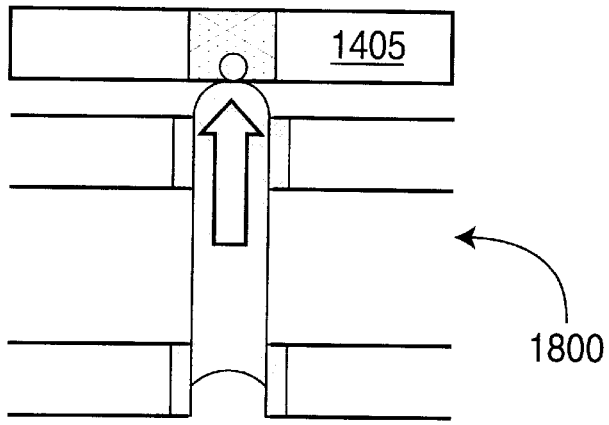
FIG. 21 is a sectional view of a plug of fluid at a fourth stage in response to the application of electronic fluid modulation.

In step 1620, method 1600 applies a pressure to the plug of fluid until a volume of fluid is transferred to the receptor. Referring to FIG. 18, prior to the application of EFM, the non-dispensing state of the plug of fluid is illustrated as having a concave air-fluid interface that is formed inside the outlet of the dispenser. When a pressure is applied to the fluid, a substantially spherical convex air-fluid interface is formed at the exit of the dispenser as shown in FIG. 19. As the pressure is increased, the spherical convex air-fluid interface makes contact with the receptor as shown in FIG. 20. When the air-fluid interface touches the receptor, a volume of fluid is transferred to the receptor due to capillary action as shown in FIG. 21. The amount of fluid that is transferred to the print receptor depends on D, the duration of the contact.

Figure 22:
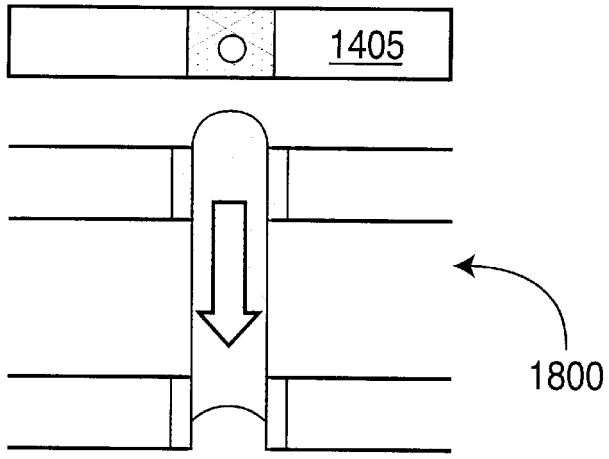
FIG. 22 is a sectional view of a plug of fluid at a fifth stage in response to the application of electronic fluid modulation.

Once a predetermined amount of fluid has been transferred, method 1600 in step 1630 removes the pressure from the plug of fluid until an air gap is re-established between the dispenser and the receptor as shown in FIG. 22.

In step 1640, method 1600 increments the counter N by one to record the completion of one cycle of fluid transfer. In step 1650, method 1600 queries whether the predefined number of cycles of fluid transfer have been completed. If the query is positively answered, then method 1600 ends in step 1660. If the query is negatively answered, then 1600 returns to step 1620 where additional cycles of fluid transfer are executed until a desired volume of fluid is transferred to the receptor.

Referring to both FIG. 14 and FIG. 15, the print array 1400 is illustrated in combination with a textured paper 1405. The above EFM method can be implemented with various fluidic arrays to transfer fluids to a receptor such as textured paper 1405. Although normal printing paper can be used with EFM, it has been found that the print media can be made to enhance EFM.

In one embodiment, textured paper 1405 is treated with various coatings, e.g., hydrophobic coatings and/or hydrophilic coatings to define hydrophilic and hydrophobic regions. In fact, this layer can be implemented as a hydrophilic membrane and then treated with a hydrophobic coating (e.g., Teflon) or vice versa. Examples of a hydrophilic membrane includes "Versapor" acrylic copolymer or "Glass Fiber Media" borosilicate glass, both from Gelman Sciences. The deposition of these hydrophobic and/or hydrophilic coatings can be achieved using conventional techniques such as masking.

Figure 17:
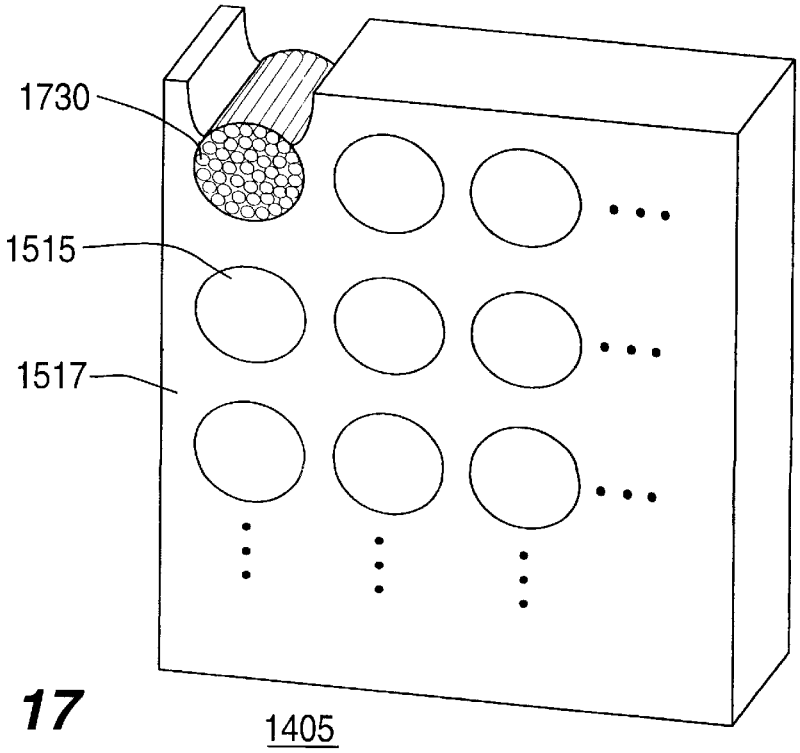
FIG. 17 is a cutout isometric view of a textured paper.
Figure 24:
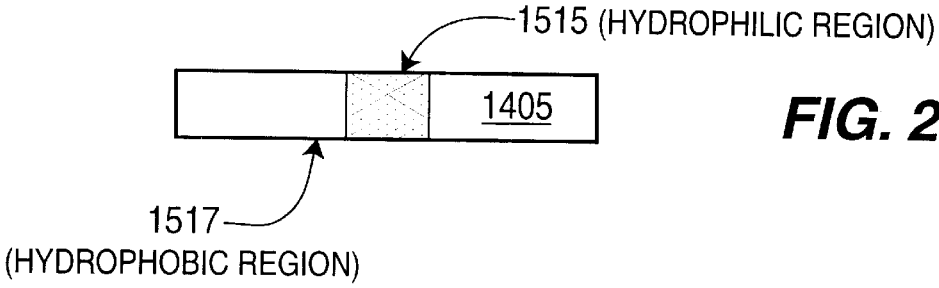
FIG. 24 is a sectional view of a textured paper.

FIG. 17 and FIG. 24 illustrate a cut-out isometric view and a sectional view of the textured paper 1405 respectively. The textured paper 1405 is designed with target regions 1515 (hydrophilic regions) where fluids (e.g., inks) are received into the paper, and regions 1517 (hydrophobic regions) where fluids are not absorbed by the paper. In fact, smaller hydrophobic regions (not shown) can be further disposed within each hydrophilic chambers 1515, as necessary for a particular implementation. Additionally, each hydrophilic chambers 1515 can be pretreated with a hydrophobic coating such that each chamber can only receive a fixed amount of fluid. Namely, once the hydrophilic chambers 1515 are saturated with fluids, no additional fluids are absorbed, thereby preventing dispersion or diffusion of fluids to adjacent hydrophilic chambers 1515. This feature is illustrated in FIG. 17, where each hydrophilic region 1515 is shown as a cylindrical cell with a plurality of capillary-like fibers 1730. The wall and one end of the cylindrical cell can be coated with a hydrophobic coating, such that capillary-like fibers 1730 is able to absorb and retain the fluid within the cylindrical cell. Although the hydrophilic regions are illustrated as substantially circular in shape, it should be understood that the hydrophilic regions can be defined in any other shapes.

The textured paper 1405 when used with EFM, exhibits a unique feature where the precise transfer of fluid onto the paper is enhanced. The hydrophilic and hydrophobic regions on the textured paper 1405 serve as an additional mechanism to selectively control the absorption of fluids by the paper. Namely, as the fluids exit the various apertures of the print array, the fluids are confined to specific locations on the textured paper 1405.

To illustrate, if a plug of fluid from a dispenser makes contact with a hydrophilic region, the fluid can be easily absorbed by the textured paper as shown above in FIG. 21. In contrast, if a plug of fluid from a dispenser makes contact with a hydrophobic region, the fluid will not be absorbed and will be retracted back into the dispenser when reverse pressure is applied. Since each cycle of the EFM generally moves a plug of fluid for a relatively short distance, there is little chance that the fluid contacting a hydrophobic region will have sufficient contact time and the necessary volume to migrate or contaminate another hydrophilic region 1515 or another dispenser on the fluidic array.

Furthermore, each hydrophilic region 1515 can be implemented as a pixel, where a plurality of dispensers or microchannels, e.g., 1412–1416, are provided to transfer one or more types of ink to each pixel as shown in FIG. 14, thereby providing the capability to generate color images.

Another unique feature in this context of having multiple dispensers transferring fluids to a single hydrophilic region 1515 is the freedom from having to provide precise alignment between the hydrophilic chambers 1515, and the apertures of the dispensers in certain applications. For example, in gray scale printing, the apertures can be slightly offset from a target hydrophilic region 1515 without causing contamination of adjacent hydrophilic regions, i.e., degradation in the printed image. The unaligned apertures for a pixel will likely make contact with both hydrophilic and hydrophobic regions, where the hydrophobic regions will prevent any fluids from being absorbed into the paper. However, this loss of fluid transfer for a particular pixel will likely occur uniformly for the entire printed image. As such, the printed image will still retain its relative gray scales between adjacent pixels.

Figure 25:
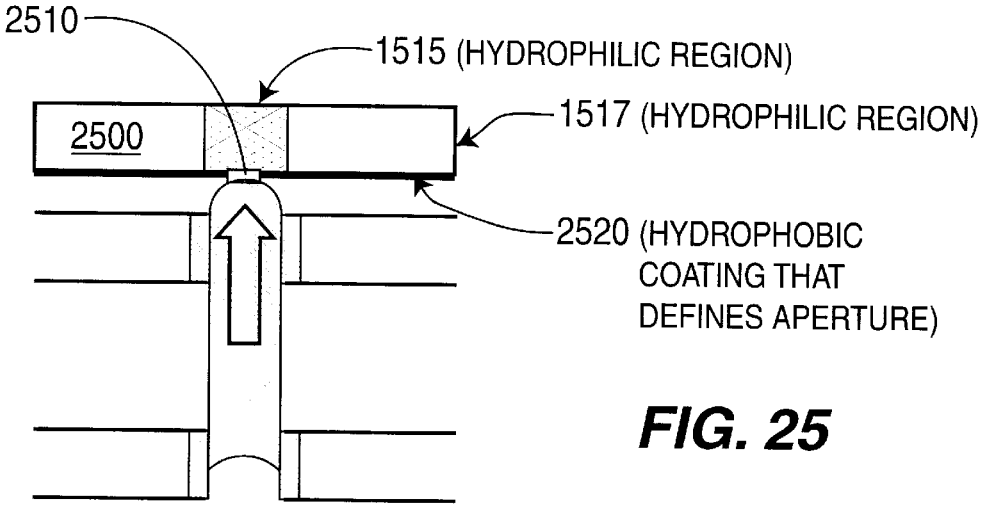
FIG. 25 illustrates an alternate embodiment of a textured paper.

FIGS. 25–28 illustrate several alternate embodiments of the present textured paper. FIG. 25 illustrates an alternate embodiment of a textured paper 2500 where a hydrophobic coating 2520 is used to define hydrophobic regions 1517 and hydrophilic chambers 1515 on the textured paper (similar to the textured paper 1405). However, unlike the textured paper 1405, the hydrophobic coating 2520 is deposited onto the paper such that an aperture 2510 is formed over each hydrophilic region 1515. As discussed above, since the contact area between the paper and the meniscus of the plug of fluid plays a role in determining the exact volume of transferred fluid, it is possible to increase that accuracy by controlling the exact aperture size leading to the hydrophilic region 1515. Knowing the exact size of the aperture 2510, allows a very good estimation as to the amount of transferred fluid for each cycle of contact between the paper and the plug of fluid.

Figure 26:
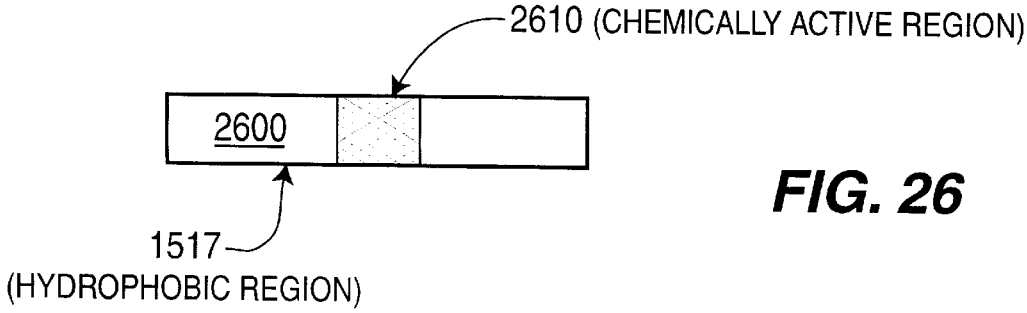
FIG. 26 illustrates another embodiment of a textured paper.

FIG. 26 illustrates an alternate embodiment of a textured paper 2600 where a hydrophobic coating is used to define hydrophobic regions 1517 on the textured paper (similar to the textured paper 1405). However, unlike the textured paper 1405, the hydrophilic regions are replaced with chemically active regions 2610. Namely, the chemically active regions 2610 are constructed from a material or having an additive or coating that will react, e.g., generating color, upon coming into contact with a particular fluid. One example is the use of a litmus-like powder or a similar material that can be selectively inserted onto the paper to form chemically active regions 2610. The fluidic array will then correspondingly dispense a fluid, e.g., an acidic or base solution, that will react with the material in the chemically active regions 2610 to cause a color change in the paper.

Figure 27:
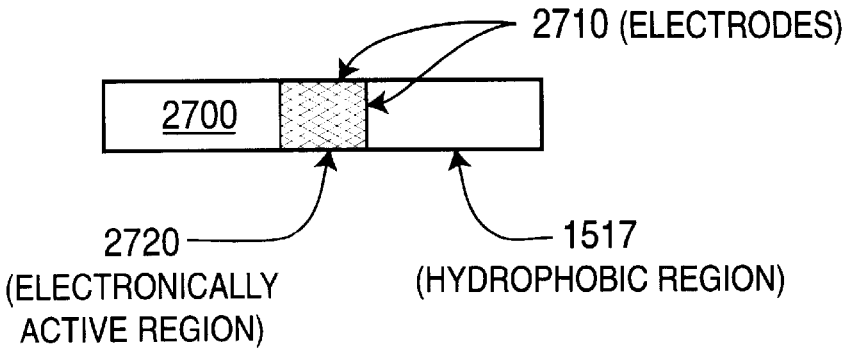
FIG. 27 illustrates another embodiment of a textured paper.
Figure 28:
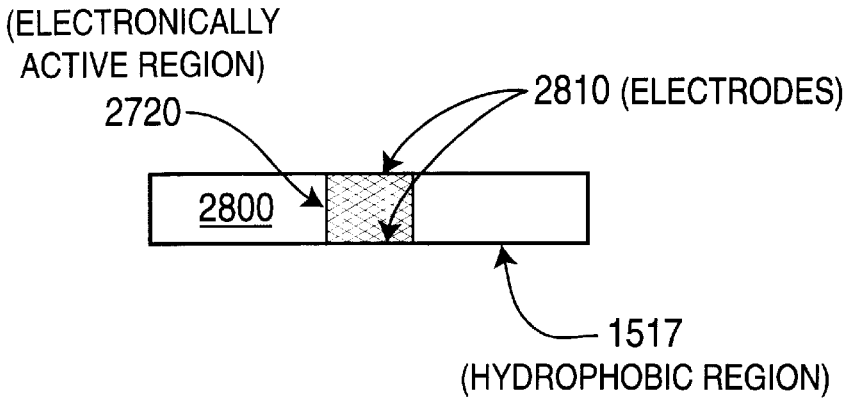
FIG. 28 illustrates another embodiment of a textured paper.

FIGS. 27 and 28 illustrate two alternate embodiments of textured papers 2700 and 2800 where a hydrophobic coating is used to define hydrophobic regions 1517 on the textured paper (similar to the textured paper 1400). However, unlike the textured paper 1405, the hydrophilic regions are converted into electronically active regions 2720. Namely, the electronically active regions 2720 are constructed by embedding a set of electrodes 2720 and 2820 as shown in FIGS. 27 and 28 respectively. The electrodes are coupled to a power source (not shown) such that each set of electrodes serve as an EHD pump. When the plugs of fluid make contact with the electronically active regions 2720, power is applied to the textured paper to assist the absorption of fluid into the paper. It should be understood that the electronically active regions 2720 can also be hydrophilic regions as well. It should be noted that the electrodes can be deposited into the electronically active regions 2720 or, alternatively, one side of the paper can be deposited with a conductive coating that serves as a common electrode for all electronically active regions 2720.

Figure 29:
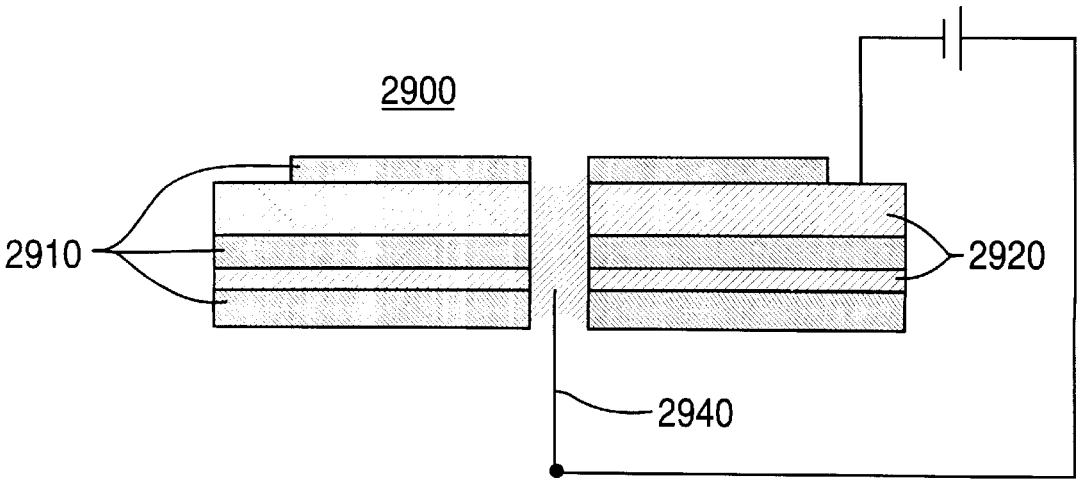
FIG. 29 is a sectional view of an array having an alternate EHD pump configuration.

FIG. 29 illustrates a sectional view of a fluidic array 2900 having an alternate EHD pump configuration. More specifically, fluidic array 2900 comprises a plurality of layers 2910 and 2920. In one embodiment, the layers 2910 are implemented using an insulating material such as glass, whereas the layers 2920 are implemented using a conductive material such as silicon. In turn, an electrode 2940 can be inserted through one of the insulating layer 2910 and is suspended within the plug of the fluid.

Using the above fluidic array 2900, a unique EHD pump can be implemented by using one of the conductive layers 2920 and the suspended electrode 2940. By applying a voltage difference or power source 2930 between one of the conductive layers 2920 and the suspended electrode 2940, the plug of fluid can be dispensed from the fluidic array 2900. It has been found that having a suspended electrode 2940 may increase the pumping power of the EHD pump for some fluids, when compared to EHD pumps using a pair of ring electrodes.

Additionally, by implementing multiple conductive layers 2920, it is possible to change the configuration of the EHD pump, i.e., selecting and applying power to a different conductive layer, relative to the suspended electrode 2940. Namely, the distance between the electrodes of the EHD pump can be selected after the fluidic array is constructed. This flexibility allows the fluidic array 2920 to be adapted to different fluid characteristics and/or applications. As discussed above, changing the distance between the electrodes of the EHD pump often changes the contribution of the forces that form the pumping power of the EHD pump. As such, it is possible to selectively apply power to a different conductive layer of the fluidic array in view of a particular fluid characteristic or application environment.

Figure 23:
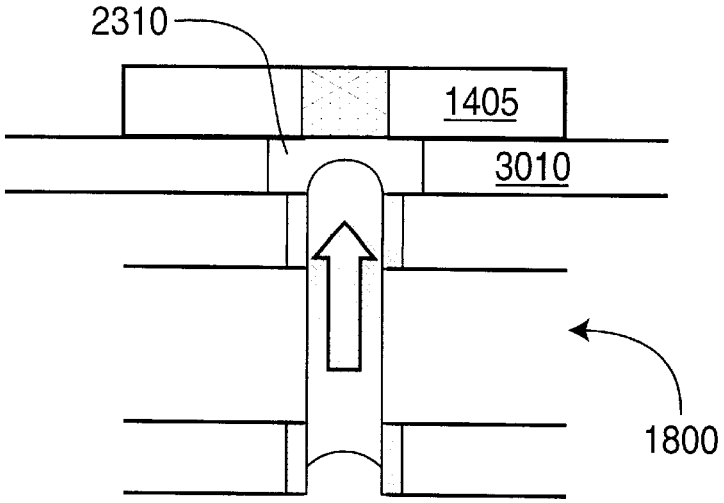
FIG. 23 is a sectional view of a fluidic array having a spacer layer.
Figure 30:
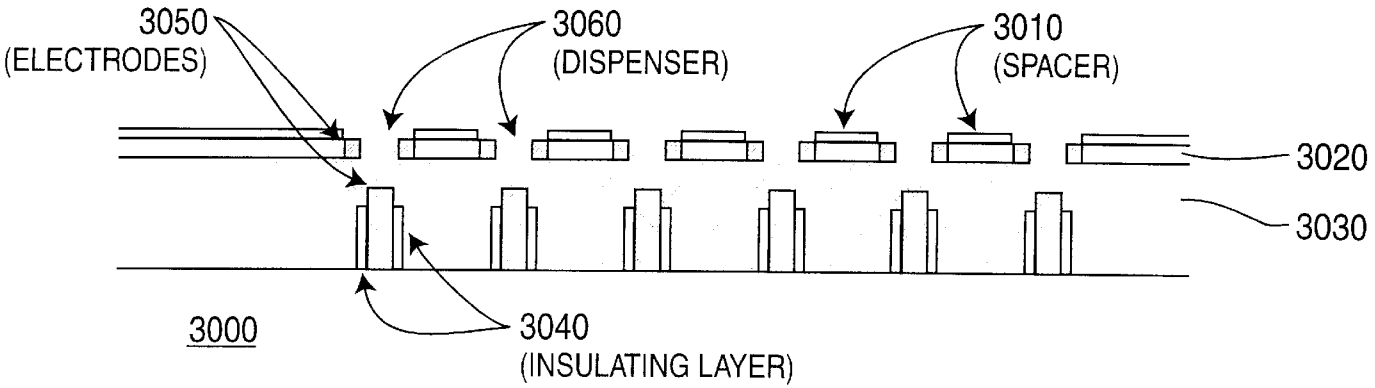
FIG. 30 illustrates another embodiment of a print array.

FIG. 30 illustrates a detailed sectional view of a fluidic array 3000 that employs the EHD pump configuration of FIG. 29. More specifically, array 3000 comprises a first layer 3010 which serves as a spacer between a paper and the fluidic array. FIG. 23 illustrates the concept of implementing a spacer layer, where an air gap 2310 is maintained between the textured paper 1405 and the first layer 3010 of the array. The air gap serves to minimize accidental or premature contact between the paper and the plug of fluid. Namely, one parameter of the above EFM method is premised on the distance that the plug of fluid must travel to come into contact with the paper. This distance, in turn, affects the estimated time in which the EHD pump must be turned on to cause the plug of fluid to travel this distance and then to dispense a volume of fluid. Ensuring and knowing the exact distance between the paper and the plug of fluid increases the accuracy of the above EFM method.

In FIG. 30, array 3000 further comprises a second layer (e.g., a conductive layer) 3020 having a ring electrode 3050, and a third layer (e.g., an insulating layer) 3040 having a post or point electrode 3050. The second and third layers also form a common feed or distribution channel 3030 that serves to feed a plurality of dispensers 3060. Although the third layer 3040 is illustrated as a plurality of cylindrical areas surrounding the post electrodes 3050, it should be understood that the third layer 3040 can be implemented as a planar layer with electrodes inserted through the planar layer. However, FIG. 30 illustrates one embodiment where additional volumes of fluid can be stored proximate to the dispenser by selectively reducing the thickness of the insulating layer 3040.

Figure 31:
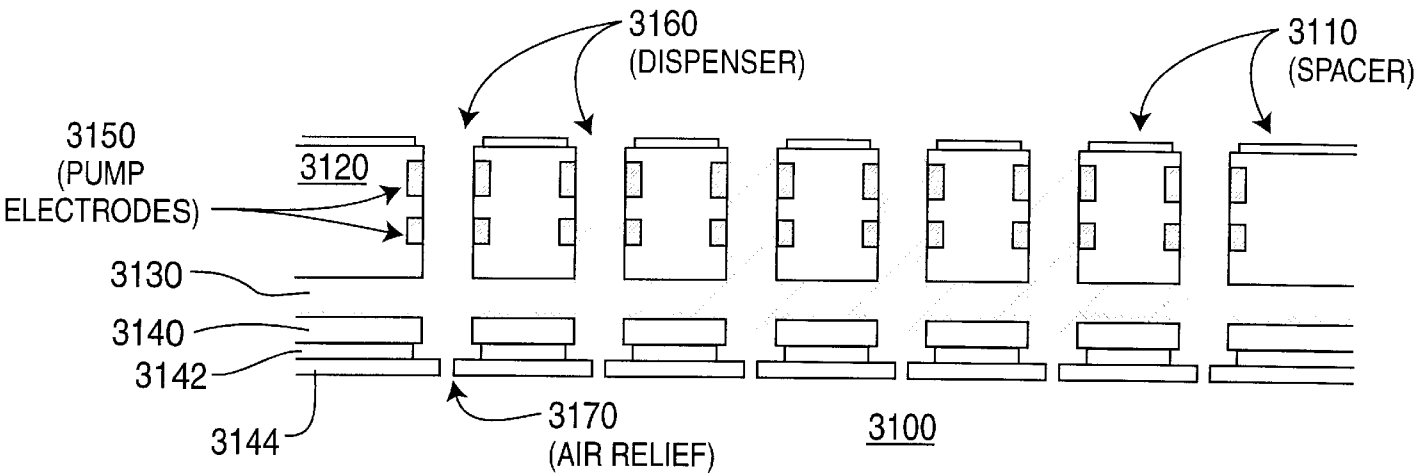
FIG. 31 illustrates another embodiment of a print array.

FIG. 31 illustrates a detailed sectional view of an alternate embodiment of a print array 3100. The print array comprises a first layer 3110 which serves as a spacer layer between a paper and the array 3100. The array 3100 further comprises a second layer (e.g., a conductive layer with one or more sublayers) 3120 having a pair of ring electrodes 3150, and a third layer (e.g., an insulating layer) 3140. Similar to the print array of FIG. 30, the second and third layers also form a common feed or distribution channel 3130 that serves to feed a plurality of dispensers 3160.

However, in contrast to the array 3000, the insulating layer 3140 comprises a plurality of apertures. In turn, an additional layer 3142 is coupled to the insulating layer 3140 to form a plurality of capillary breaks. Finally, an additional layer 3144 is coupled to the insulating layer 3140 to form a plurality of air reliefs 3170. The function of the layers 3140, 3142, and 3144 is to maintain the physical behavior of the plug of fluids in a print array. The air reliefs can be implemented as apertures or via an appropriate membrane. Preferably, layer 3144 is implemented using a breathable membrane. Namely, layer 3144 allows gases to pass through freely, but prevents the fluid from passing through layer 3144 of the print array.

It is to be understood that the apparatus and method of operation taught herein are illustrative of the invention. Modifications may readily be devised by those skilled in the art without departing from the spirit or scope of the invention.

What is claimed is:

1. A final print medium for receiving a fluid to form a desired image on a surface of the final print medium, said final print medium comprising:

a plurality of target regions on the final medium for receiving said fluid; and a plurality of hydrophobic regions on the final medium separating the plurality of target regions wherein the hydrophobic and the target regions are configured such that the target regions receive the fluid from corresponding nozzles of a print array to the relative exclusion of the hydrophobic regions.

2. A final print medium according to claim 1, wherein said target regions are hydrophilic regions.

3. A final print medium according to claim 1, wherein said target region is a chemically active region.

4. A final print medium according to claim 3, wherein the plurality of target regions include a plurality of chemical action cells.

5. A final print medium according to claim 4, further including means for receiving a precise amount of the fluid into each of the chemical reaction cells.

6. The print system of claim 1, wherein said target region is an electronically active region.

7. A final print medium to claim 4, wherein final print medium includes a membrane having a surface on which the plural of the chemical reaction cells are formed.

8. A final print medium according to claim 7, further comprising a hydrophobic coating over the membrane having a plurality of apertures defining the respective plurality of chemical reaction cells.

9. A final print medium according to claim 8, wherein each of the apertures has a size which determines an amount of the fluid that is deposited into the respective reaction cell.

* * * * *